US012421804B2

(12) United States Patent
Corona et al.

(10) Patent No.: US 12,421,804 B2
(45) Date of Patent: Sep. 23, 2025

(54) CONTINUOUS SAMPLING DRILL BIT

(71) Applicant: VERACIO LTD., Salt Lake City, UT (US)

(72) Inventors: Robert Andrew Corona, Salt Lake City, UT (US); Michael Ravella, Salt Lake City, UT (US); Adrian Brubacher, North Bay (CA)

(73) Assignee: Veracio Ltd., Salt Lake City, UT (US)

( * ) Notice: Subject to any disclaimer, the term of this patent is extended or adjusted under 35 U.S.C. 154(b) by 0 days.

(21) Appl. No.: 17/614,728

(22) PCT Filed: May 21, 2021

(86) PCT No.: PCT/US2021/033612
§ 371 (c)(1),
(2) Date: Nov. 24, 2022

(87) PCT Pub. No.: WO2022/245366
PCT Pub. Date: Nov. 24, 2022

(65) Prior Publication Data

US 2023/0358103 A1 Nov. 9, 2023

(51) Int. Cl.
*E21B 10/60* (2006.01)
*E21B 10/04* (2006.01)

(52) U.S. Cl.
CPC ..... *E21B 10/605* (2013.01); *E21B 10/04* (2013.01)

(58) Field of Classification Search
CPC ..... E21B 10/605; E21B 10/04; E21B 10/48; E21B 17/18; E21B 21/12
See application file for complete search history.

(56) References Cited

U.S. PATENT DOCUMENTS

| | | | | |
|---|---|---|---|---|
| 3,308,896 | A | 3/1967 | Henderson | |
| 3,323,604 | A * | 6/1967 | Henderson | E21B 10/04 175/215 |
| 3,951,220 | A | 4/1976 | Phillips, Jr. et al. | |
| 7,828,090 | B2 | 11/2010 | Drivdahl et al. | |
| 10,626,676 | B1 * | 4/2020 | Drenth | E21B 49/02 |
| 2012/0061146 | A1 | 3/2012 | Pearce et al. | |
| 2016/0145946 | A1 | 5/2016 | Pearce et al. | |

(Continued)

FOREIGN PATENT DOCUMENTS

| | | | |
|---|---|---|---|
| GB | 900099 | A | 7/1962 |
| WO | WO 1994023172 | A1 | 10/1994 |

*Primary Examiner* — Nicole Coy
*Assistant Examiner* — Jennifer A Railey
(74) *Attorney, Agent, or Firm* — Ballard Spahr LLP

(57) ABSTRACT

A drill bit having a central axis can comprise a shank defining an inner bore and a crown having a cutting face. The crown can define an outer operative circumference. The crown can comprise a core-receiving slot in communication with the inner bore of the shank. One or more peripheral slots can be in communication with the inner bore of the shank. The crown can comprise one or more face channels that are in communication with the core-receiving slot and a respective peripheral slot. A base portion can be positioned within the core-receiving slot. The base portion can define a breaking surface. The peripheral slots can be configured to receive fluid moving in a distal direction toward the cutting face of the crown. The face channels can be configured to deliver fluid from the respective peripheral slot to the core-receiving slot.

29 Claims, 17 Drawing Sheets

(56) References Cited

U.S. PATENT DOCUMENTS

| | | | |
|---|---|---|---|
| 2017/0268295 | A1 | 9/2017 | Rindeskär |
| 2017/0362900 | A1 | 12/2017 | Pearce et al. |
| 2021/0054695 | A1 | 2/2021 | Drenth et al. |

* cited by examiner

CONTINUOUS SAMPLING DRILL BIT

CROSS-REFERENCE OF RELATED APPLICATIONS

This Application is a national phase application under 35 U.S.C. § 371 of International Application No. PCT/US2021/033612, filed on May 21, 2021, the content of which is hereby incorporated by reference in its entirety.

BACKGROUND

Conventionally, core sampling requires a wireline assembly for retrieving a cylindrical core sample drilled by a core sampling bit. Such core sampling is a time consuming and intensive process that requires complex wireline tooling. Accordingly, a need exists for a sampling method that eliminates wireline tooling and does not require a need to stop drilling to separate samples from the formation or to retrieve samples. Continuous sampling methods that use percussive pneumatic hammers are limited to non-water-bearing (dry) formations, require air circulation, have high energy consumption, and suffer from further limitations of percussive drill bits.

SUMMARY

Described herein, in various aspects, is a drill bit drill bit having a central axis. The drill bit can comprise a shank defining an inner bore and a crown having a cutting face. The crown can define an outer operative circumference. The crown can comprise a core-receiving slot in communication with the inner bore of the shank. At least one peripheral slot can be in communication with the inner bore of the shank. The at least one peripheral slot can be positioned radially between the core-receiving slot and the outer operative circumference of the crown. The crown can further comprise at least one face channel. Each face channel of the at least one face channel can extend between and be in fluid communication with the core-receiving slot and a respective peripheral slot of the at least one peripheral slot. A base portion can be positioned within the core-receiving slot. The base portion can define a breaking surface. At least a portion of the breaking surface, or a plane tangential thereto, can be oriented at an oblique angle to the central axis. The at least one peripheral slot can be configured to receive fluid moving in a distal direction toward the cutting face of the crown. The at least one face channel can be configured to deliver fluid from the at least one peripheral slot to the core-receiving slot.

A drilling assembly can comprise an outer tube and an inner tube received within the outer tube so that the inner tube and the outer tube cooperate to define an annular space. The shank of the drill bit can be threadedly coupled to the outer tube. The drilling assembly can further comprise a sub that provides fluid communication between, the core receiving slot of the crown of the drill bit and the inner tube.

A method can comprise advancing the drilling assembly into a formation to form drilling cuttings and core segments. The method can further comprise pumping fluid through the annular space and collecting the core segments returning through the inner tube.

In another aspect, a drill bit can have a central axis. The drill bit can comprise a shank defining an inner bore and a crown having a cutting face. The crown can define an outer operative circumference. The crown can comprise a core-receiving slot in communication with the inner bore of the shank. The crown can further comprise at least one face channel, wherein each face channel of the at least one face channel extends between and is in communication with the core-receiving slot and the outer operative circumference of the crown. A base portion can be positioned within the core-receiving slot. The base portion can define a breaking surface. At least a portion of the breaking surface, or a plane tangential thereto, can be oriented at an oblique angle to the central axis. The at least one face channel can be configured to receive fluid flowing distally along the outer surface of the crown and deliver fluid from the outer surface of the crown to the core-receiving slot.

Additional advantages of the invention will be set forth in part in the description that follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DESCRIPTION OF THE DRAWINGS

These and other features of the preferred embodiments of the invention will become more apparent in the detailed description in which reference is made to the appended drawings wherein.

DETAILED DESCRIPTION

Figure 1:
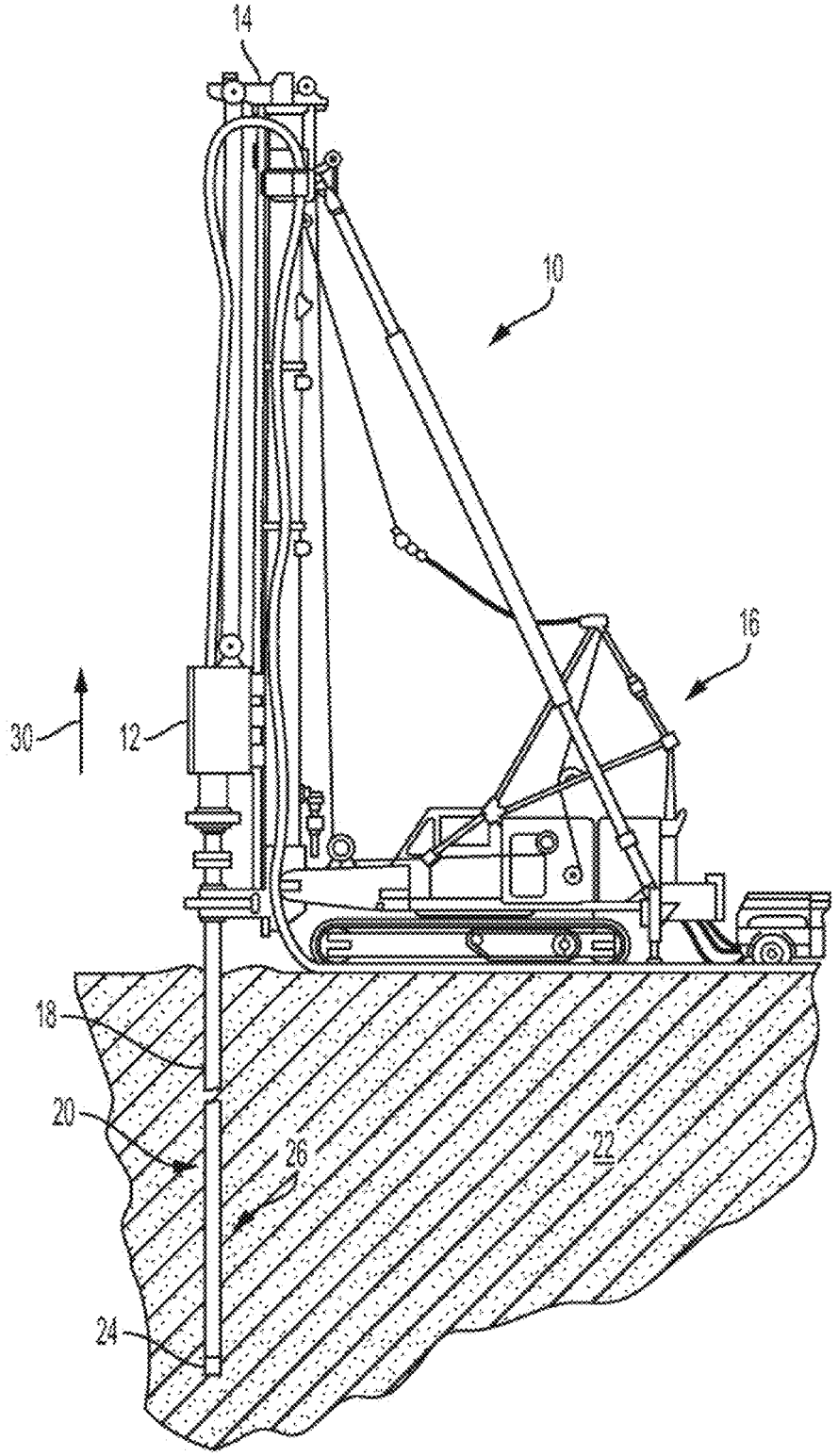
FIG. 1 is a drill rig operating drilling assembly in accordance with embodiments disclosed herein.
Figure 2:
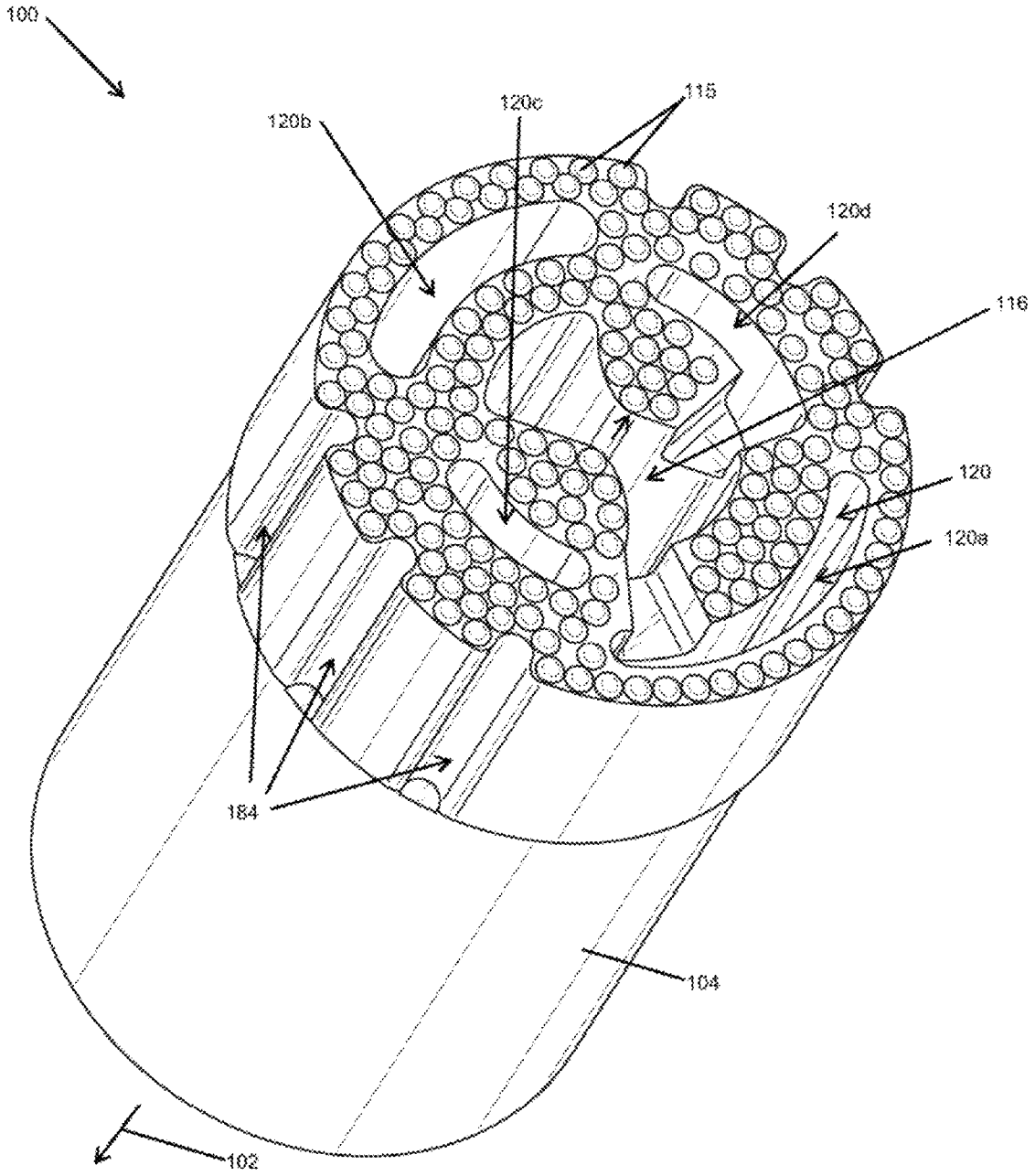
FIG. 2 is a distal end perspective view of a drill bit in accordance with embodiments disclosed herein.

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout. It is to be understood that this invention is not limited to the particular methodology and protocols described, as such may vary. It is also to be understood that the terminology used herein is for the purpose of describing particular embodiments only, and is not intended to limit the scope of the present invention.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

As used herein the singular forms "a," "an," and "the" include plural referents unless the context clearly dictates otherwise. For example, use of the term "a crown portion" can refer to one or more of such crown portions, and so forth.

All technical and scientific terms used herein have the same meaning as commonly understood to one of ordinary skill in the art to which this invention belongs unless clearly indicated otherwise.

As used herein, the terms "optional" or "optionally" mean that the subsequently described event or circumstance may or may not occur, and that the description includes instances where said event or circumstance occurs and instances where it does not.

As used herein, the term "at least one of" is intended to be synonymous with "one or more of" For example, "at least one of A, B and C" explicitly includes only A, only B, only C, and combinations of each.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. Optionally, in some aspects, when values are approximated by use of the antecedent "about," it is contemplated that values within up to 15%, up to 10%, up to 5%, or up to 1% (above or below) of the particularly stated value can be included within the scope of those aspects. Similarly, if further aspects, when values are approximated by use of "approximately," "substantially," and "generally," it is contemplated that values within up to 15%, up to 10%, up to 5%, or up to 1% (above or below) of the particularly stated value can be included within the scope of those aspects. In still further aspects, when angular relationships (e.g., "parallel" or "perpendicular") are approximated by use of "approximately," "substantially," or "generally," it is contemplated that angles within 15 degrees (above or below), within 10 degrees (above or below), within 5 degrees (above or below), or within 1 degree (above or below) of the stated angular relationship can be included within the scope of those aspects.

The word "or" as used herein means any one member of a particular list and also includes any combination of members of that list.

As used herein, the term "proximal" refers to a direction toward a drill rig or drill operator and generally opposite a direction of drilling (and away from a formation or borehole), while the term "distal" refers to a direction away from the drill rig or drill operator and generally in the direction of drilling (and into a formation or borehole).

It is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

The following description supplies specific details in order to provide a thorough understanding. Nevertheless, the skilled artisan would understand that the apparatus, system, and associated methods of using the apparatus can be implemented and used without employing these specific details. Indeed, the apparatus, system, and associated methods can be placed into practice by modifying the illustrated apparatus, system, and associated methods and can be used in conjunction with any other apparatus and techniques conventionally used in the industry.

According to various aspects, the devices, systems, and methods disclosed herein can be used in continuous sampling of a formation. That is, formation samples, comprising relatively small cuttings and/or larger core segments (further described herein), can be retrieved as the formation is drilled using reverse circulation. The formation samples can be tested and inspected in order to determine the makeup and various other information regarding the formation (e.g., information conventionally determined via core samples retrieved via conventional wireline). In contrast to conventional wireline core sampling, the disclosed devices, systems, and methods enable samples to be collected while drilling, greatly increasing sampling rate. Additionally, it is contemplated that the samples can be associated with the depth at which they were collected. That is, the time delay between the depth at which the samples were removed from the formation and subsequently pumped from the proximal end of the borehole and collected can be accounted for (e.g., using a known rate of travel of the samples at a given flow rate).

Disclosed herein, with reference to FIG. 1, is a drill bit for use with a drilling system 10 that includes a drill head 12. The drill head 12 can be coupled to a mast 14 that, in turn, is coupled to a drill rig 16. The drill head 12 can be configured to have one or more tubular threaded members 18 coupled thereto. Tubular members 18 can include, without limitation, drill rods, casings, and down-the-hole hammers. Optionally, in some aspects, use of embodiments disclosed herein can eliminate a need for down-the-hole hammers. For ease of reference, the tubular members 18 will be described herein as drill string components. Each drill string component 18 can in turn be coupled to additional drill string components 18 to form a drill or tool string 20. In turn, the drill string 20 can be coupled at a distal end to a drilling tool 24, such as a rotary drill bit, impregnated, core sampling drill bit, or percussive bit, configured to interface with the material, or formation 22, to be drilled. The drilling tool 24 can form a borehole 26 in the formation 22.

According to some implementations of the present invention, the drilling tool can include a reverse circulation continuous sampling drill bit 100, such as those depicted and described in relation to FIGS. 2-6 and 7-10.

In reverse circulation systems, a pressurized fluid is pumped down the borehole 26. The fluid can be pumped down an outer annulus, such as, for example, a space between the borehole 26 and the outer wall of the drill string 20. The fluid can then return through an interior of the drill string 20. In reverse circulation drilling, the returning fluid can provide fluid pressure to move certain components or materials in a proximal direction along (optionally, up) the drill string. As disclosed herein, the returning fluid can carry core sample bits in a proximal direction along (optionally, up) the drill string and to the borehole outlet. Further aspects of reverse circulation systems are disclosed in International Application No. WO 2018/152089 to BLY IP INC., filed Feb. 13, 2018, which is hereby incorporated herein in its entirety. The reverse circulation system can exclude air circulation, which can be beneficial in water-bearing formations in which air cannot be circulated. Because fluid can be passed around the outer wall of the drill string 20, dual-tube drill strings may not be required. That is, in some aspects, and as further described herein, the drill string may only comprise a single tube that is coupled to the drill bit 100. However, according to further aspects, it is contemplated that dual-tube drill strings can be used under conditions where the ground/formation is not suitable for acting as an outer wall of a conduit through which fluid can be pumped (e.g., porous or soft ground conditions).

In various aspects and with reference to FIGS. 2-6, the drill bit 100 can have a central axis 102. The drill bit 100 can comprise a shank 104 defining an inner bore 106. The shank 104 can define at least one thread 108 (e.g., one or more female threads) that are configured to couple to the drill string 20 (FIG. 1). Optionally, referring also to FIGS. 7-10, the shank 104 can define one or more through-holes 107 that extend radially outwardly from the inner bore 106 to an outer circumferential surface 109 of the shank 104. Said through-holes 107 can optionally extend at an acute angle relative to the central axis so that the through-holes have outlets at the outer circumference that are distal of the inlets at the inner bore 106, thereby directing flow toward the distal end of the drill bit.

Figure 4:
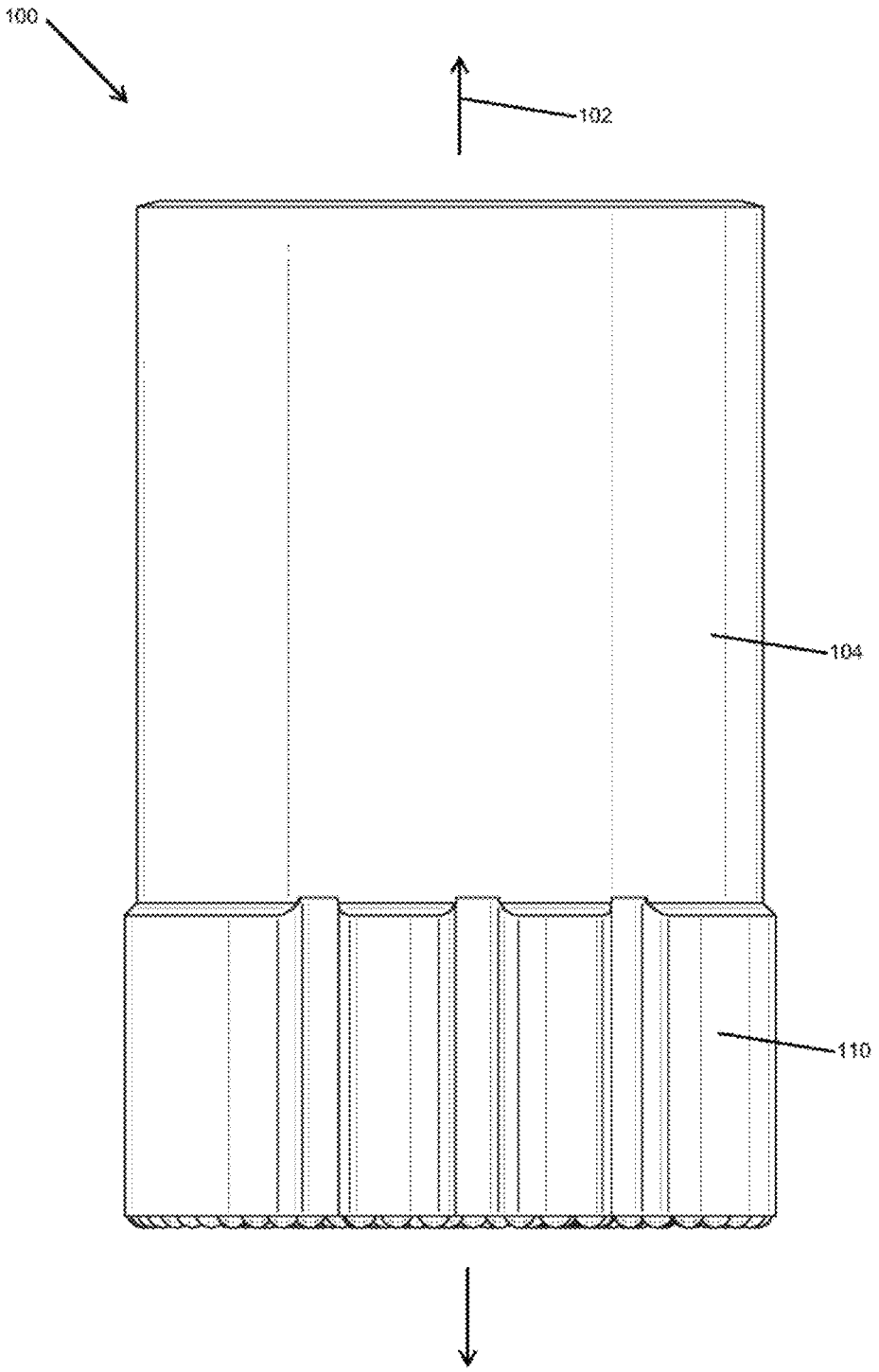
FIG. 4 is side view of the drill bit of FIG. 2.
Figure 5:
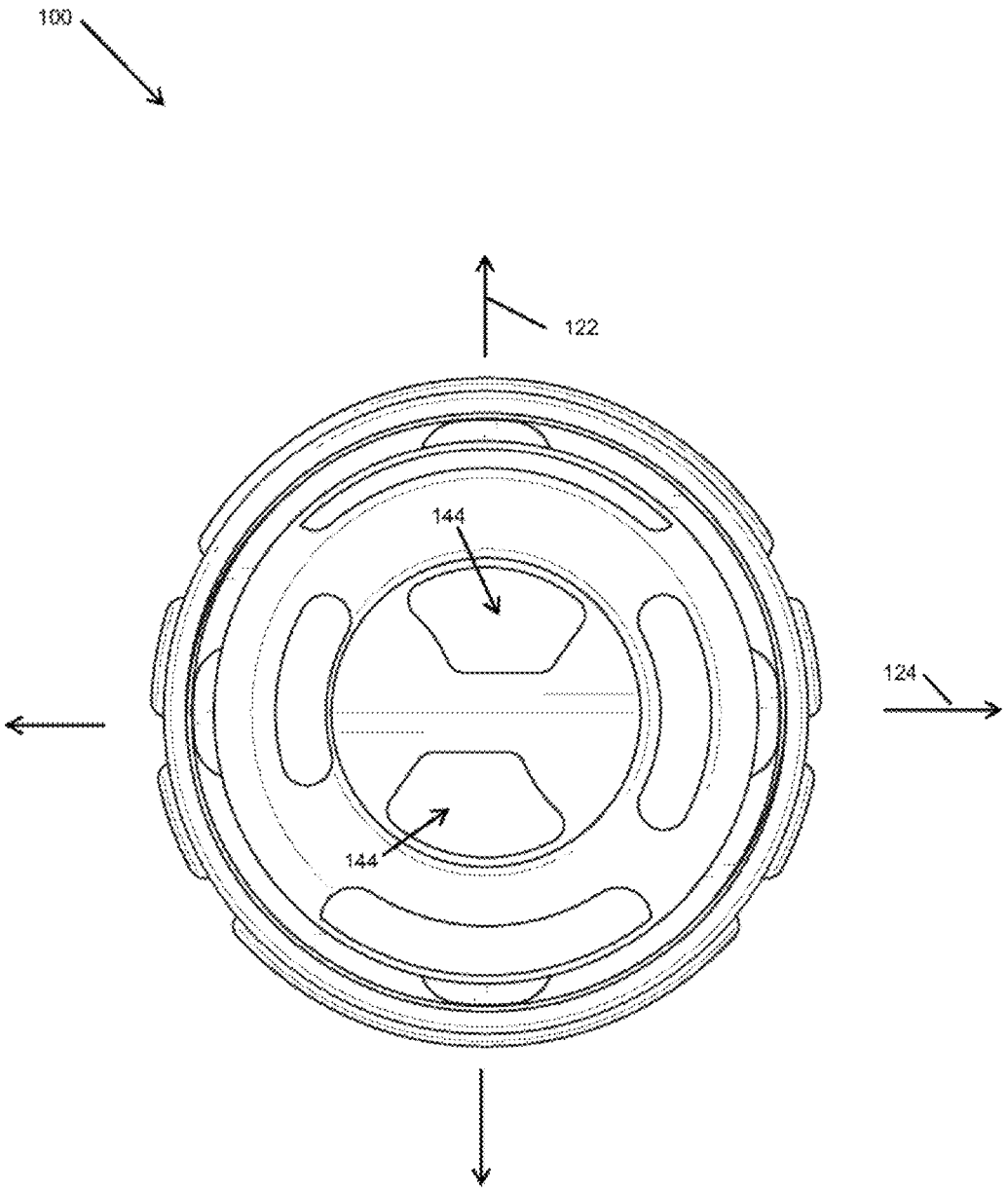
FIG. 5 is a proximal end view of the drill bit of FIG. 2.

The drill bit 100 can further comprise a crown 110, which can have a cutting face 112 that defines an outer operative circumference 114 (FIG. 4). An operative circumference can be defined as a continuous pathway (e.g., a circular or round pathway), formed within a plane that is perpendicular to the central axis 102, by tracing and connecting respective portions of the inner surfaces or outer surfaces of the crown. Thus, the operative circumference simulates a boundary or perimeter that would exist if the inner or outer surface of the crown extended continuously (without interruption) over 360 degrees. Accordingly an outer operative circumference can circumscribe an outer surface of the crown, and an inner operative circumference can circumscribe one or more inner surfaces of the crown.

The crown 110 can comprise a core receiving slot 116 in communication with the inner bore 106 of the shank 104. The core receiving slot 116 can define an inner operative circumference 118. That is, as the bit rotates, the cutting face 112 of the drill bit 100 can define an inner area that the cutting face 112 does not engage. Accordingly, as the drill bit 100 advances into a formation, a portion 200 of the formation within the inner operative circumference can remain intact with the formation and extend inwardly into the core receiving slot 116. In some aspects, the area of the inner operative circumference 118 can range from less than about 5 square centimeters to about 18 square centimeters in cross section. In still further aspects, the inner operative circumference 118 can have a diameter ranging from about 5 mm to about 40 mm, or from about 8 mm to about 25 mm. In further aspects, the inner operative circumference can have a diameter of less than 5 mm or greater than 40 mm.

Figure 11:
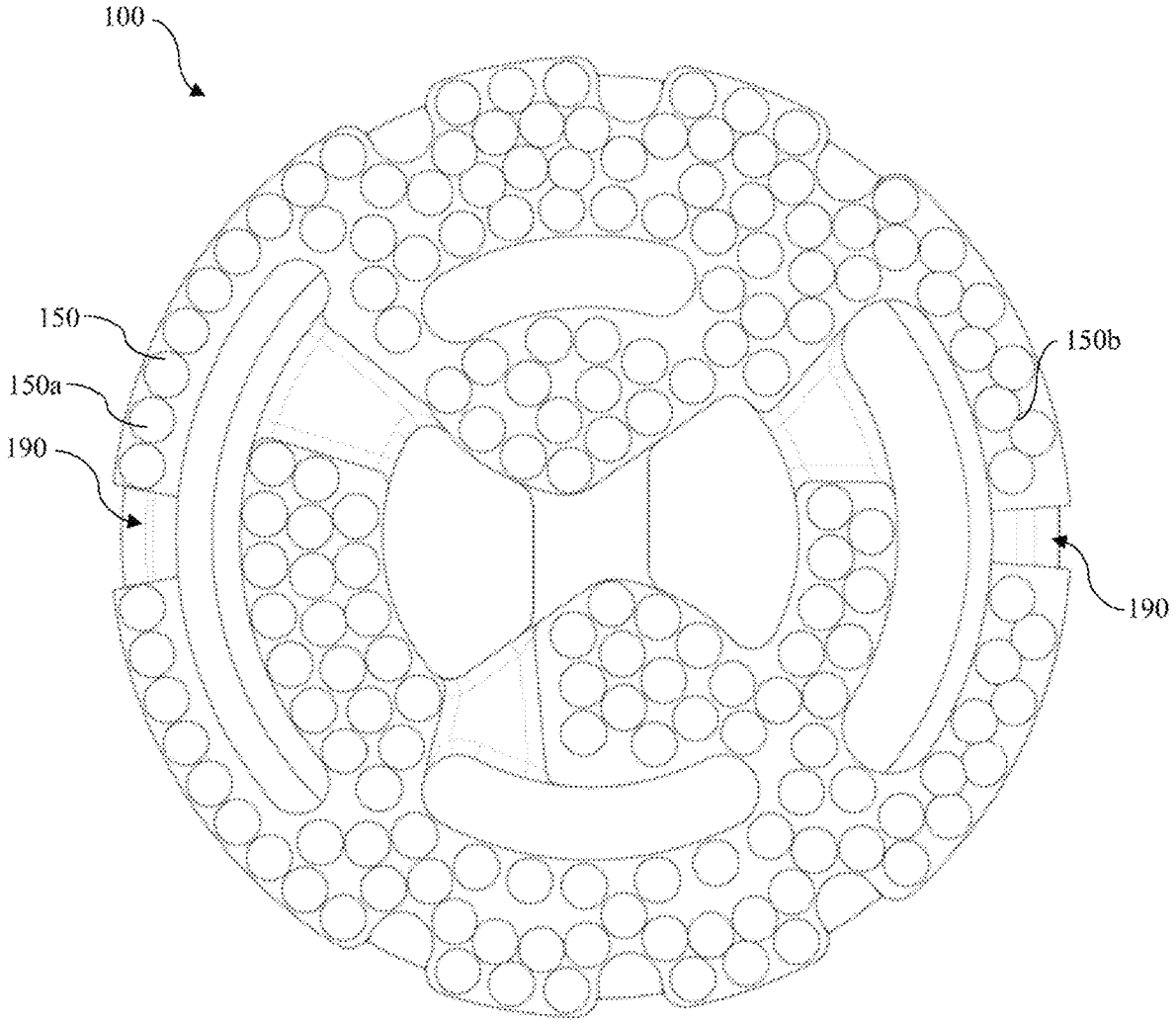
FIG. 11 is a distal end view of an exemplary drill bit.
Figure 12:
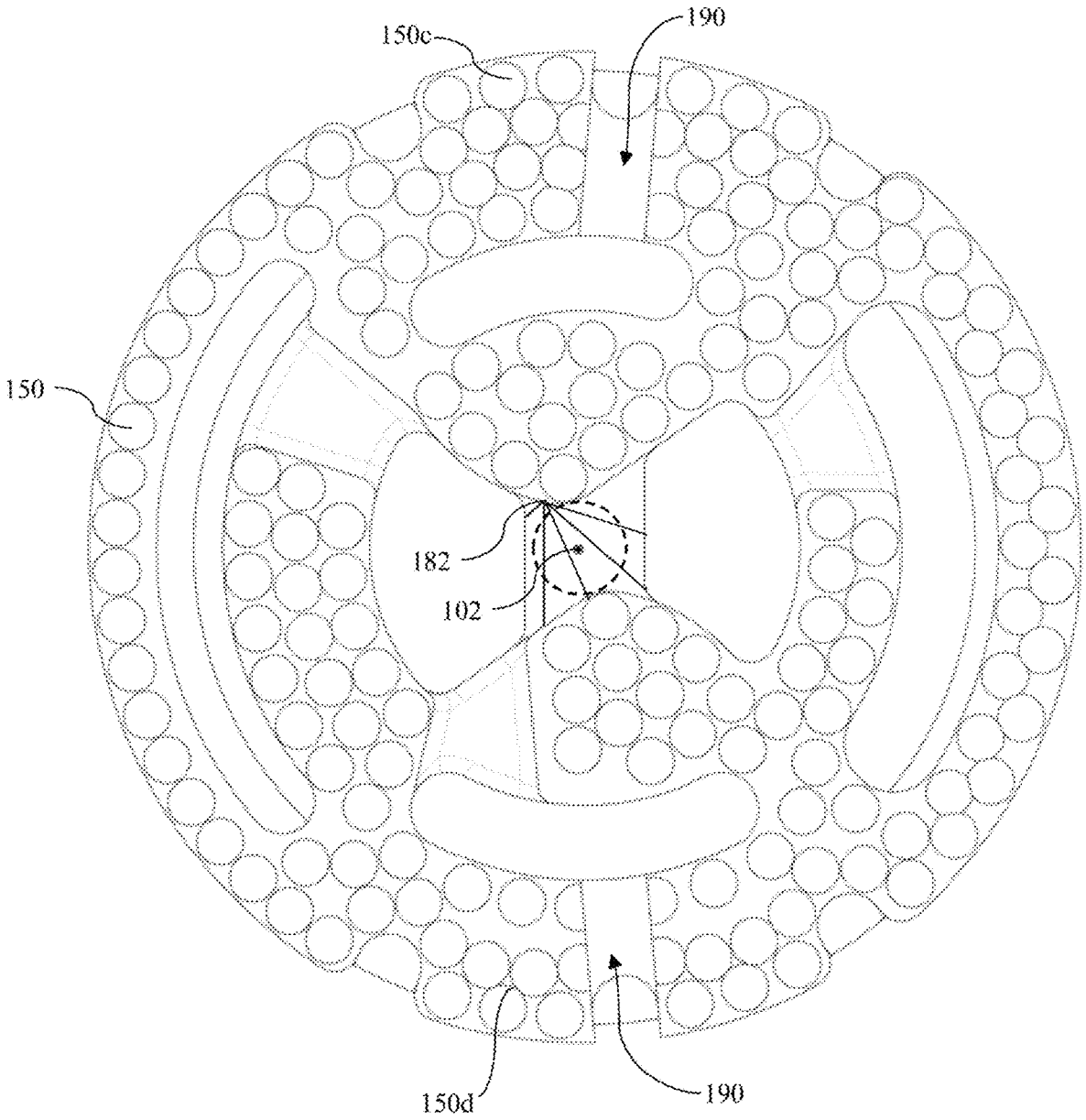
FIG. 12 is a distal end view of an exemplary drill bit.
Figure 13:
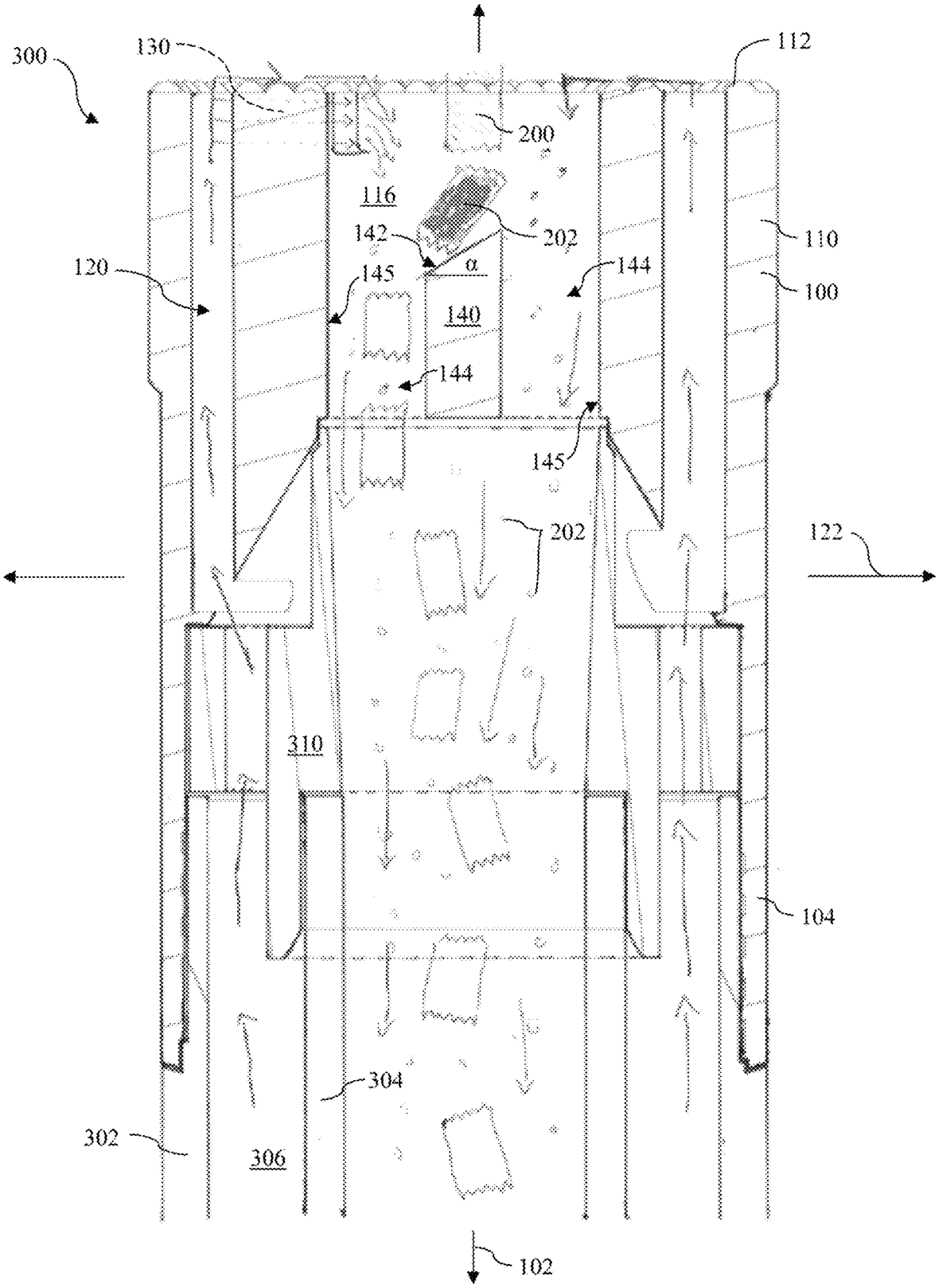
FIG. 13 is a cross sectional diagram of a drilling assembly comprising an exemplary drill bit, further showing the operation of fluid, drilling cuttings, and core segment flow.
Figure 14:
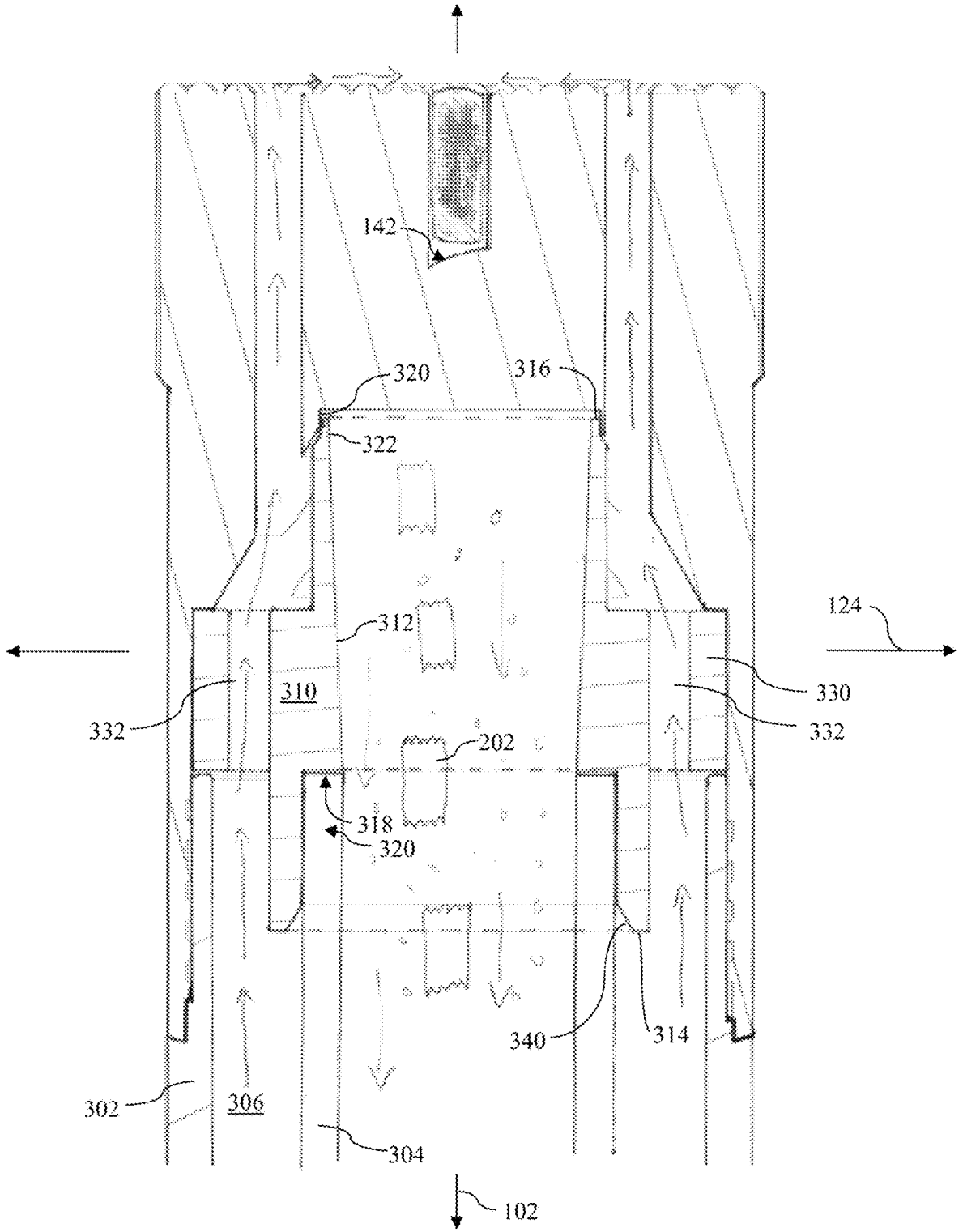
FIG. 14 is a cross sectional diagram of the drilling assembly of FIG. 11 taken in a plane that is perpendicular to the cutting plane of FIG. 11.

Referring to FIGS. 11 and 12, the crown can define a base portion 140 positioned within the core receiving slot 116. Optionally, as further disclosed herein, the base portion 140 can extend between opposing sides of the core-receiving slot 116. The base portion 140 can define a breaking surface 142. At least a portion of the breaking surface can be oriented at an oblique angle to the central axis. In this way, the breaking surface can be configured so that as the portion 200 of the formation within the core receiving slot (core sample) biases against the breaking surface 142, the breaking surface can apply a stress to the core sample to cause it to break, thereby providing for collection of a core segment 202. For example, referring to FIG. 13, in some optional aspects, the breaking surface 142 can intersect a first plane including the central axis 102 and a first transverse axis 122 at a line. The line can form a break angle, $\alpha$, with the first transverse axis 122. The break angle can be between about 15 and about 45 degrees, or about 30 degrees. Referring to FIG. 14, in some optional aspects, the breaking surface 142 can intersect a second plane including the central axis 102 and a second transverse axis 124 that is perpendicular to the first transverse axis 122 at an arc having a proximal concavity (a concavity that faces in a proximal direction). Thus, in some aspects, across the break surface, no plane that is tangential to the break surface can be perpendicular to the central axis 102. Optionally, in some aspects, the break surface 142 can have a conical shape with an apex 182. In some aspects, the base portion 140 can have an apex 182 that corresponds to a distal-most point on the base portion. In some aspects, the apex 182 can be radially spaced from the central axis 102. Thus, as the cylindrical core sample 304 engages the base portion 140, the cylindrical core sample can undergo a lateral force that causes the core sample to break off. Optionally, in these aspects, the apex 182 can be spaced from the central axis 102 of the drill bit 100 relative to the first transverse axis 122. Optionally, in another aspect, the apex 182 can be spaced from the central axis 102 of the drill bit 100 relative to the second transverse axis 124. In further aspects, the break surface 142 can be planar and oriented at an acute angle relative to the central axis 102.

The apex 182 can be spaced from the central axis 102 by at least the radius of the inner operative circumference 118. In exemplary aspects, the apex 182 (FIG. 12) of the breaking surface 142 of the base portion 140 can be spaced from the cutting face 112 along the central axis 102 of the drill bit 100 by between 0.1 inches and 0.5 inches (e.g., about 0.21 inches) along the second axis 124 and between 0.1 inches and 0.5 inches (e.g., about 0.315 inches). Optionally, in one exemplary aspect, the axial distance between the base portion 140 and the cutting face 112 along the central axis 106 can vary moving across the base portion relative to the first transverse axis 122. In a further exemplary aspect, the axial distance between the base portion 140 and the cutting face 112 along the central axis 106 can vary moving across the base portion relative to the second transverse axis 124. In yet another exemplary aspect, the axial distance between the base portion 140 and the cutting face 112 relative to the central axis 106 can vary moving across the base portion along both the first transverse axis 122 and the second transverse axis 124. Optionally, in exemplary aspects, said axial distance can range from about 1 inch to about 2.5 inches, or from about 1.3 inches to 2.3 inches, or about 1.96 inches, or from 0.25 to 1.5 inches, or from 0.35 inches to about 1.22 inches.

In optional contemplated aspects, at least a portion of the breaking surface 142 can be substantially planar, and at least a portion of the breaking surface can be curved (either distally or proximally). In other contemplated aspects, the breaking surface 142 can have a compound curvature, with a first portion of the breaking surface having a first radius of curvature and at least a second portion of the breaking surface having a second radius of curvature different from the first radius of curvature. For example, the breaking surface 142 can be conical.

At least one conduit 144 (e.g., a pair of conduits 144 disposed on opposing sides of the breaking surface 142 along the first transverse axis 122) can communicate the core segments 202 to the inner bore 106 of the shank 104. Accordingly, the conduits 144 can have minor dimensions that are greater than the major dimensions of the core segments 202 to inhibit clogging. It is contemplated that the major dimensions of the core segments can optionally be less than the length from the cutting face to the breaking surface (e.g., about 1 inch or less). The core segment 202 that has broken off can be centrifugally ejected radially outwardly from the base portion 140. The cylindrical core sample 304 can optionally be further broken apart into smaller pieces that pass through the conduits 144.

The crown 110 can further comprise one or more peripheral slots 120 in communication with the inner bore 106 of the shank 104. In some aspects, the crown can comprise only one single peripheral slot 120. Each peripheral slot 120 can be positioned radially between the core-receiving slot 116 and the outer operative circumference of the crown. In further aspects, the crown can comprise a plurality of peripheral slots 120 (optionally, two, three, four, at least three, at least four, or more peripheral slots).

The crown 110 can comprise one or more face channels 130. Each face channel 130 can extend between, and be in fluid communication with, a respective peripheral slot 120 and the core receiving slot 116. Optionally, the crown 110 can comprise only one single face channel 130. In further aspects, the crown 110 can comprise a plurality of face channels 130. Each peripheral slot can be configured to receive fluid moving in a distal direction toward the cutting face of the crown. The face channels can be configured to deliver the fluid from the respective peripheral slot to the core receiving slot. In this way, cuttings 204 and core segments 202 can be flushed through the conduits 144, into the shank, and through the drill string. The cuttings 204 can be understood to be the portions of the formation that are formed by engagement between the cutting face 112 of the crown 110 and the formation, as are formed during conventional drilling.

Optionally, each peripheral slot 120 can be in fluid communication with a respective face channel 130 that extends between the peripheral slot and the core receiving slot. In further aspects, at least one peripheral slot 120 (optionally, a plurality of peripheral slots) is not in communication with any of the face channels 130. In this way, fluid can be delivered to the cutting face 112 for cooling of the cutting face and removal of cuttings therefrom. In some aspects, the crown can define at least one radial flow channel 190 (FIGS. 11-12) extending between the outer operative circumference of the crown and a respective peripheral slot 120.

In some optional aspects, the crown 110 can comprise a plurality of peripheral slots 120 and at least two face channels. For example, the crown 110 can comprise at least three peripheral slots 120 and at least two face channels. Optionally, the crown 110 can comprise four peripheral slots. In further aspects, the plurality of peripheral slots can consist of four peripheral slots. For example, the crown 110 can have a first peripheral slot 120*a*, a second peripheral slot 120*b*, a third peripheral slot 120*c*, and a fourth peripheral slot 120*d*. The first and second peripheral slots 120*a,b* can define a first pair of peripheral slots that are spaced along a first transverse axis 122 that is perpendicular to (or substantially perpendicular to) the central axis 102, and the third and fourth peripheral slots 120*c,d* can define a second pair of peripheral slots that are spaced along a second transverse axis 124 that is perpendicular to (or substantially perpendicular to) the central axis 102 (and, optionally, the first transverse axis 122).

Figure 6:
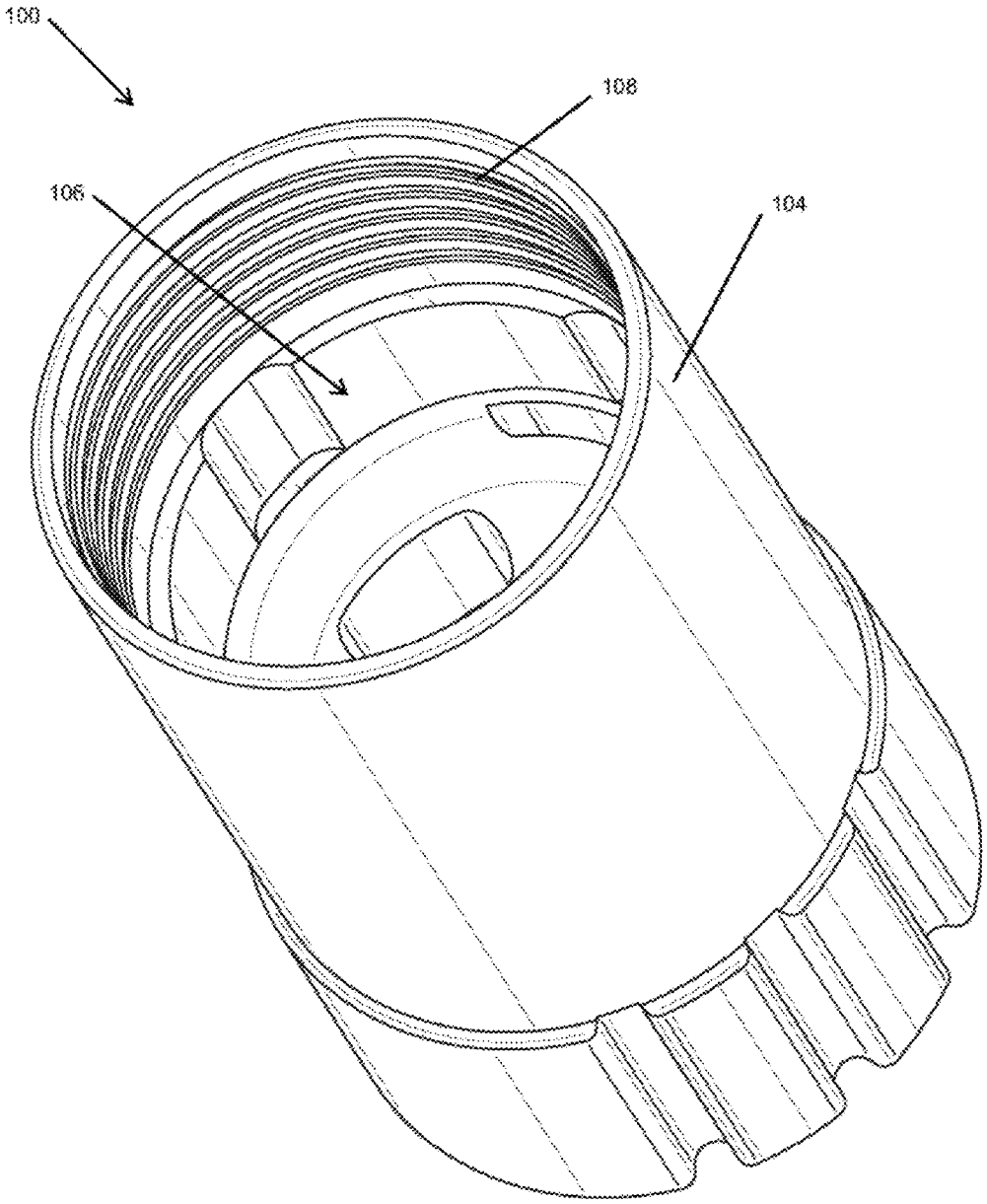
FIG. 6 is a proximal end perspective view of the drill bit of FIG. 2.
Figure 7:
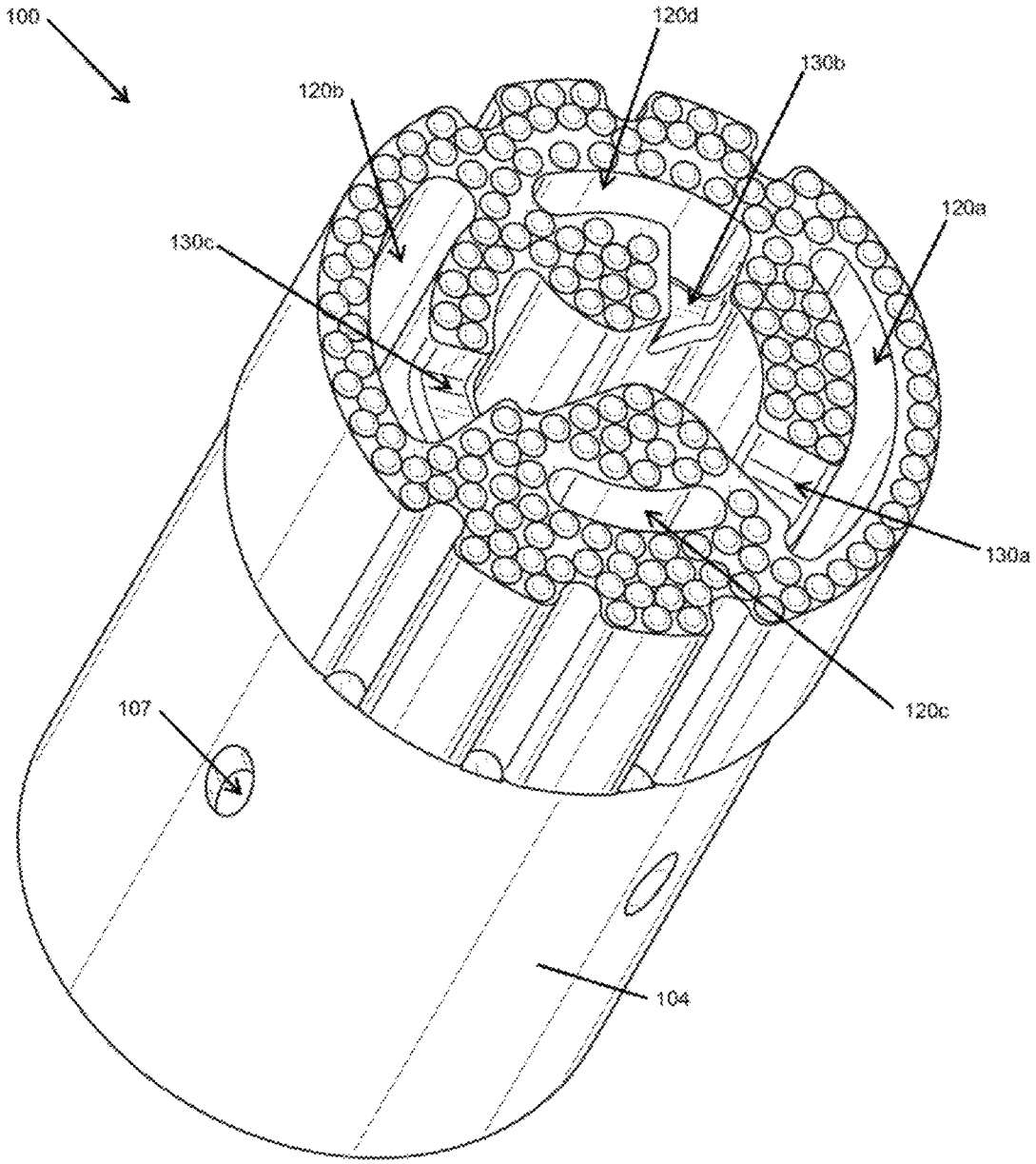
FIG. 7 is a distal end perspective view of another drill bit in accordance with embodiments disclosed herein.
Figure 8:
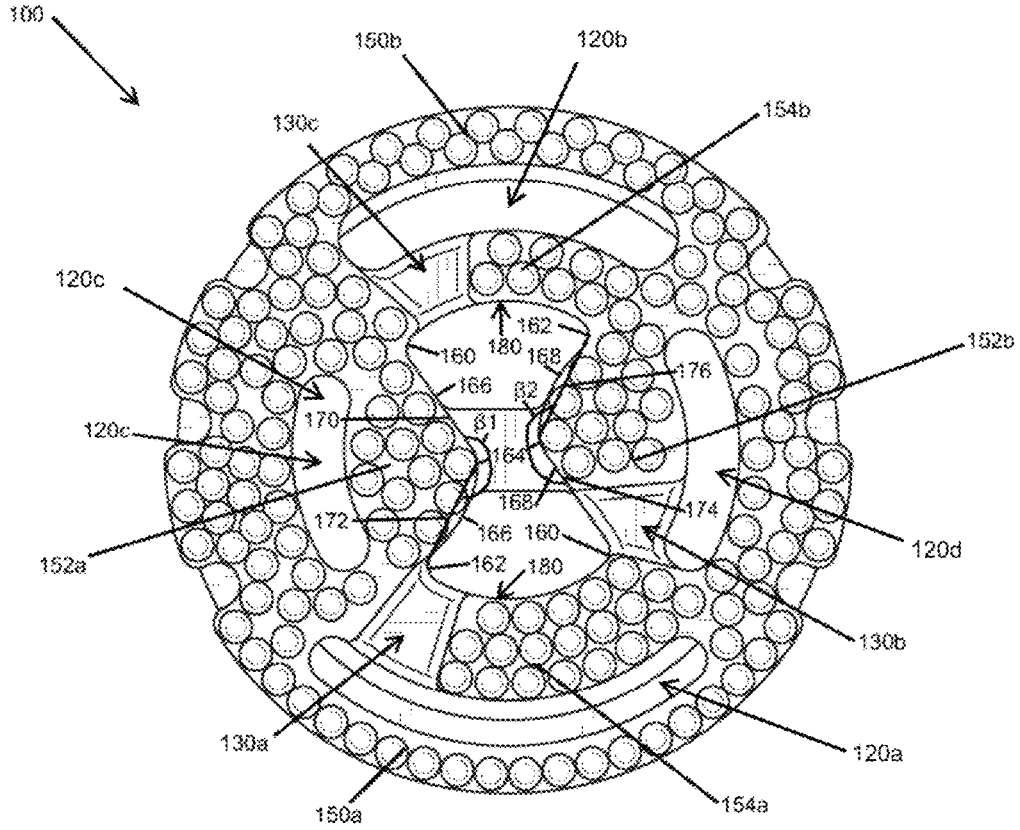
FIG. 8 is a distal end view of the drill bit of FIG. 7.
Figure 9:
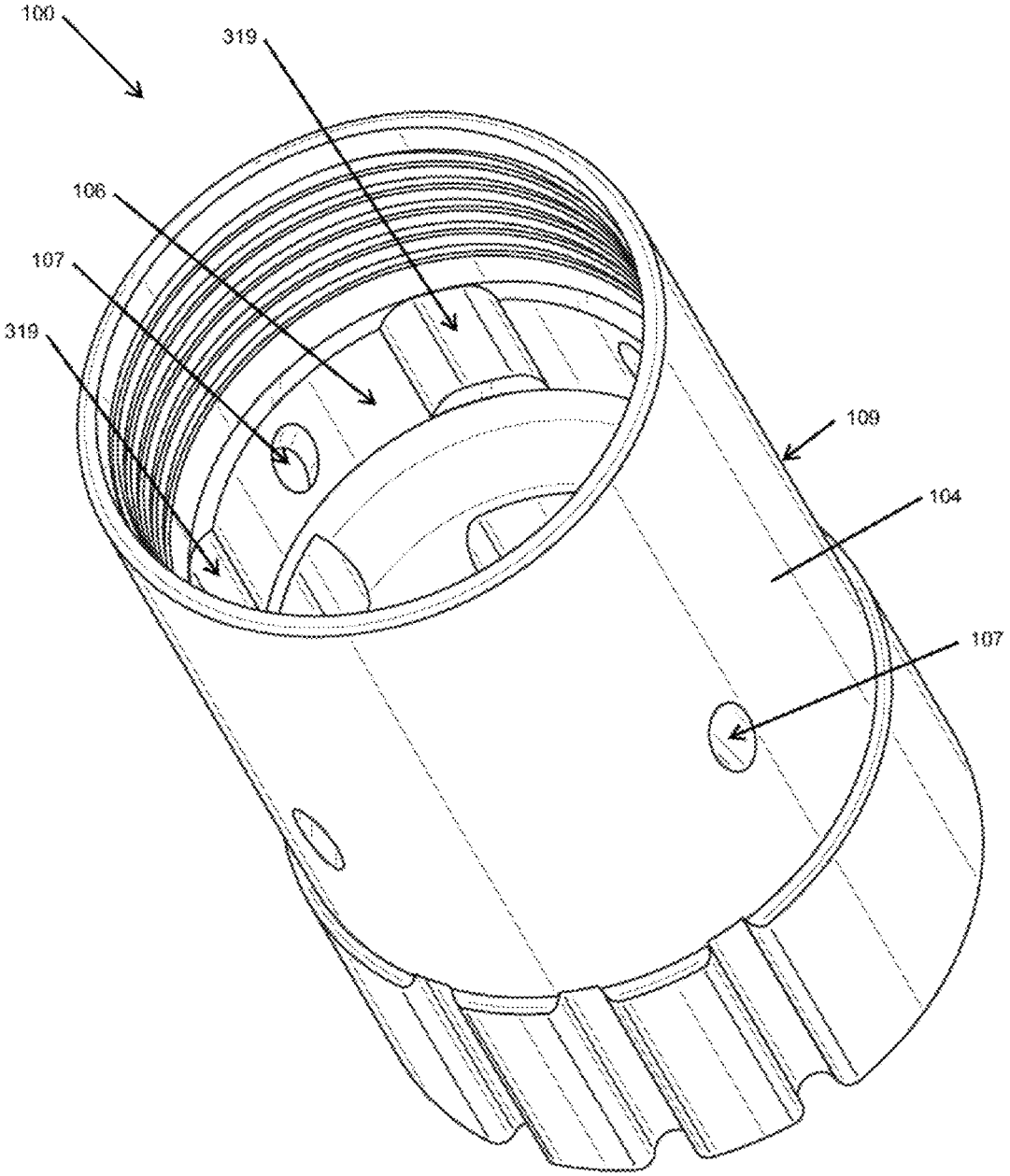
FIG. 9 is a proximal end perspective view of the drill bit of FIG. 7
Figure 10:
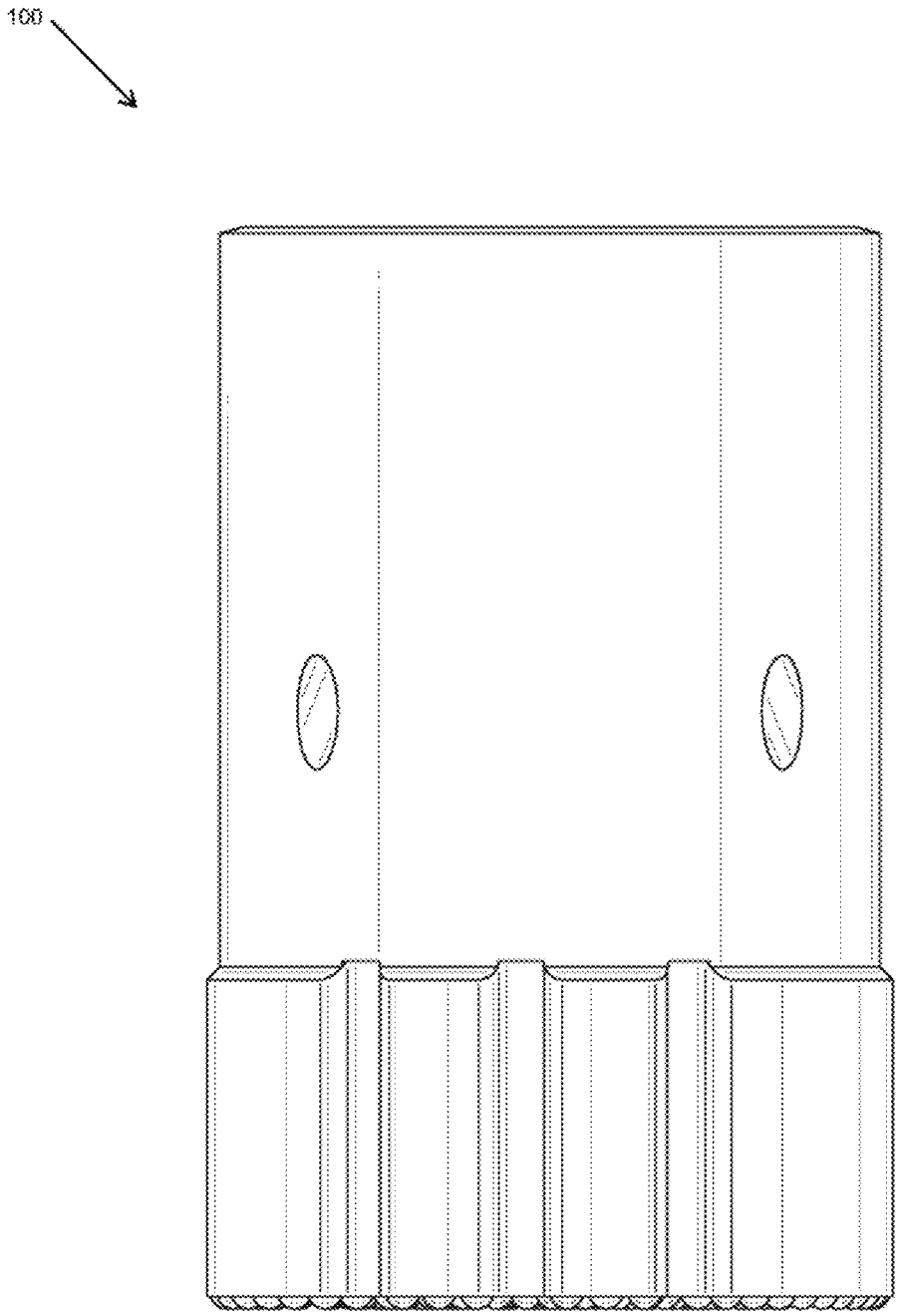
FIG. 10 is a side view of the drill bit of FIG. 7.

Referring to FIGS. 6 and 8, the crown 110 can comprise a wall 150 that defines the outer operative circumference of the crown. Optionally, the wall 150 can be continuous along the entire operative circumference of the crown. The crown 110 can further comprise a plurality of inner crown portions that define the core receiving slot. For example, the crown 110 can comprise opposing first and second core-forming inner crown portions 152*a,b* that define the inner operative circumference and first and second non-core-forming inner crown portions 154*a,b*. Optionally, each peripheral slot 120 can be at least partly defined by a respective inner crown portion. For example, the first peripheral slot 120*a* can be defined at least partially by a first outer wall portion 150*a* of the wall 150 and the first non-core-forming inner crown portion 154*a*, and the second peripheral slot 120*b* can be defined at least partially by a second outer wall portion 150*b* of the wall 150 and the second non-core-forming inner crown portion 154*b*. In further aspects, the third peripheral slot 120*c* can be defined at least partially by a third outer wall portion 150*c* of the wall 150 and the first core-forming inner crown portion 152*a*, and the fourth peripheral slot 120*d* can be defined at least partially by a fourth outer wall portion 150*d* of the wall 150 and the second core-forming inner crown portion 152*b*. In some aspects, the base portion can extend between the first and second core-forming inner crown portions 152*a,b*. Optionally, in some aspects, the apex 182 of the base portion can be positioned proximate one of the first or second inner core-forming inner crown portions 152*a,b*.

In some aspects, each face channel 130 can be defined, in part or in its entirety, by a respective inner crown portion (e.g., a crown portion selected from among the first and second core-forming inner crown portions 152*a,b* and the first and second non-core-forming inner crown portions 154*a,b*). In some optional aspects, the crown portion that at least partially defines a peripheral slot can also define a face channel that extends between said peripheral channel and the core-receiving slot 116. For example, the first non-core-forming inner crown portion 154*a* can define a first face channel 130*a*. The first face channel 130*a* can extend between and be in communication with the core-receiving slot 116 and the first peripheral slot 120*a*. The second core-forming inner crown portion 152*b* can at least partially define a second face channel 130*b* that extends between, and is in communication with, the core-receiving slot 116 and the fourth peripheral slot 120*d*. Referring to FIGS. 7-10, in further aspects, the second non-core forming inner crown portion 154*b* can define a third face channel 130*c* that extends between the core receiving slot 116 and the second peripheral slot 120*b*. In optional aspects, one or more of the face channels 130 can be positioned proximate to one end of the respective peripheral slot 120. For example, each of the face channels 130 can be positioned proximate to the clockwise end of each respective peripheral slot 120 when viewing the distal end of the drill bit. In this way, the first and second face channels 130*a,b* can deliver fluid to the core-receiving slot 116 proximate to the conduit 144 on the low (proximal-most) side of the breaking surface 142, which the core segments 202 are most likely to break toward and travel through (as illustrated in FIG. 13).

It is contemplated that the peripheral slots 120 can be sized and positioned in order to provide even or substantially even cutting area (to the extent possible) at different radii from the central axis across the face of the drill bit. In this way, the drill bit 100 can be configured to wear evenly. The peripheral slots 120 can further be sized to maximize open area while maintaining the integrity of the bit body. In some aspects, the peripheral slots 120 can be maintained at a spacing (e.g., radial spacing) of at least 0.3 inches or at least 0.35 inches from each of the core receiving slot 116 and the axial channels 184. Accordingly, in various aspects peripheral slots 120 on opposing sides of the central axis 120 can be unevenly spaced from the central axis and can have different arc lengths, radial thickness, and/or cross sectional areas in transverse planes perpendicular to the central axis 120. As should be understood, the arc length of the peripheral slot can be defined as a length of an arc spaced equally between a radially inner edge of the peripheral slot at the cutting face and a radially outer edge of the peripheral slot at the cutting face. In various exemplary, optional aspects, the first peripheral slot 120*a* can have a radius of curvature of between 1 and 2 inches (e.g., about 1.50 inches), an arc length of between 1 and 3 inches (e.g., about 2.34 inches), and an axial width from 0.1 inches to 0.5 inches (e.g., about 0.25 inches); the second peripheral slot 120*b* can have a radius of curvature of between 1 and 2 inches (e.g., about 1.39 inches), an arc length of between 1 and 3 inches (e.g., about 1.95 inches), and an axial width from 0.1 inches to 0.5 inches (e.g., about 0.37 inches); the third peripheral slot 120*c* can have a radius of curvature of between 1 and 2 inches (e.g., about 1.04 inches), an arc length of between 1 and 3 inches (e.g., about 1.10 inches), and an axial width from 0.1 inches to 0.5 inches (e.g., about 0.29 inches); the fourth peripheral slot can have a radius of curvature of between 1 and 2 inches (e.g., about 1.13 inches), an arc length of between 1 and 2 inches (e.g., about 1.36 inches, and an axial width from 0.1 inches to 0.5 inches (e.g., about 0.29 inches).

Thus, according to some aspects, the at least one peripheral slot 120 can have a different arc length than at least one other peripheral slot 120. For example, the first slot 120*a* can have a greater arc length than the second slot 120*b*. In some aspects, the third slot 120*c* can have a shorter arc length than the fourth arc length 120*d*.

In further aspects, at least one peripheral slot 120 can have a radial thickness that is different from another peripheral slot 120, wherein the radial thickness is defined as the dimension of the slot along an axis that extends radially from the central axis and through the peripheral slot. For example, the first peripheral slot 120*a* can have a narrower radial thickness along the first transverse axis 122 than the second peripheral slot 120*b*. In further aspects, the third peripheral slot 120*c* can have a radial thickness that is less than the fourth peripheral slot 120*d*. In further aspects, at least two, or, optionally, all of the peripheral slots can have the same radial thickness.

Referring to FIG. 8, in some optional aspects, the first and second core-forming inner crown portions 152*a,b* can each comprise a first axial edge 160, a second axial edge 162, and a medial axial edge 164 disposed between the first axial edge 160 and the second axial edge 162. A first inner surface 166 can extend between the first axial edge 160 and the medial axial edge 164, and a second inner surface 168 can extend between the second axial edge 162 and the medial axial edge 164. In some aspects, the first inner surface 166 of the first core-forming inner crown portion 152*a* can be planar or substantially planar. In further aspects, the first inner surface 166 of the second core-forming inner crown portion 152*b* can be planar or substantially planar. In some optional aspects, the second inner surface 168 of the first core-forming inner crown portion 152*a* can have a convex curvature. In further optional aspects, the second inner surface 168 of the second core-forming inner crown portion 152*b* can have a convex curvature. In various other aspects, any of the first or second inner surfaces 166, 168 of the first and second core-forming inner crown portions 152*a,b* can be planar, concave, or convex, serpentine, or the like, as desirable. For example, in some aspects, each of the first and second inner surfaces 166, 168 can be planar. In further aspects, each of the first and second inner surfaces 166, 168 can be concave. In still further aspects, the first and second surfaces 166, 168 of the first and second core-forming inner crown portions 152*a,b* can be defined by a single continuous surface profile with no definite boundary therebetween.

In some embodiments, the innermost surfaces of the crown 110 can be longitudinal medial edges 164 of the first and second core-forming inner crown portions 152*a,b*. As the drill bit 100 rotates, the innermost surfaces can circumscribe, and thereby define, the core receiving space. In some aspects, the core receiving space can be cylindrical. Thus, in use, the core received within the core receiving slot 116 can form a cylindrical core sample portion.

In some aspects, a first plane 170 can contain the first axial edge 160 and the medial axial edge 164 of the first core-forming inner crown portion 152*a*, and a second plane 172 can contain the second axial edge 162 and the medial axial edge 164 of the first core-forming inner crown portion 152*a*. In some aspects, the first and second planes 170, 172 can be angularly oriented relative to one another at an angle, β1, of greater than 180 degrees, such as, for example, an angle from about 190 degrees to about 240 degrees. In some aspects, a third plane 174 can contain the first axial edge 160 and the medial axial edge 164 of the second core-forming inner crown portion 152*b*, and a fourth plane 176 can contain the second axial edge 162 and the medial axial edge 164 of the second core-forming inner crown portion 152*b*. In some aspects, the third and fourth planes 174, 176 be angularly oriented relative to one another at an angle, β2, of greater than 180 degrees, such as, for example, an angle from about 190 degrees to about 240 degrees. For example, optionally, each of β1 and β2 can be at least about 180 degrees, between about 190 and 260 degrees, or about 245 degrees. It is contemplated that a greater angle can increase penetration rate by increasing the open area of the bit while decreasing bit life by removing material from the bit that is subject to the greatest amount of wear.

As one will appreciate, during normal clockwise rotation of the drill bit 100, the second inner surface 168 of the first and second core-forming inner crown portions 152*a,b* can serve as the leading edges of the drill bit. However, it is contemplated that the direction of rotation of the drill bit can be reversed so that the first inner surfaces 166 of the first and second core-forming inner crown portions 152*a,b* can serve as the leading edges of the drill bit.

In some aspects, the first and second non-core-forming inner crown portions 154*a,b* can have respective inner surfaces 180 that have concave curvatures.

Although various edges, planes, surfaces, and angles disclosed in the preceding paragraphs are only depicted in FIG. 8 (with respect to an embodiment including three face channels), it is contemplated that these same edges, planes, surfaces, and angles (and other associated features) can be present in other embodiments disclosed herein, including embodiments with only two face channels.

Figure 3:
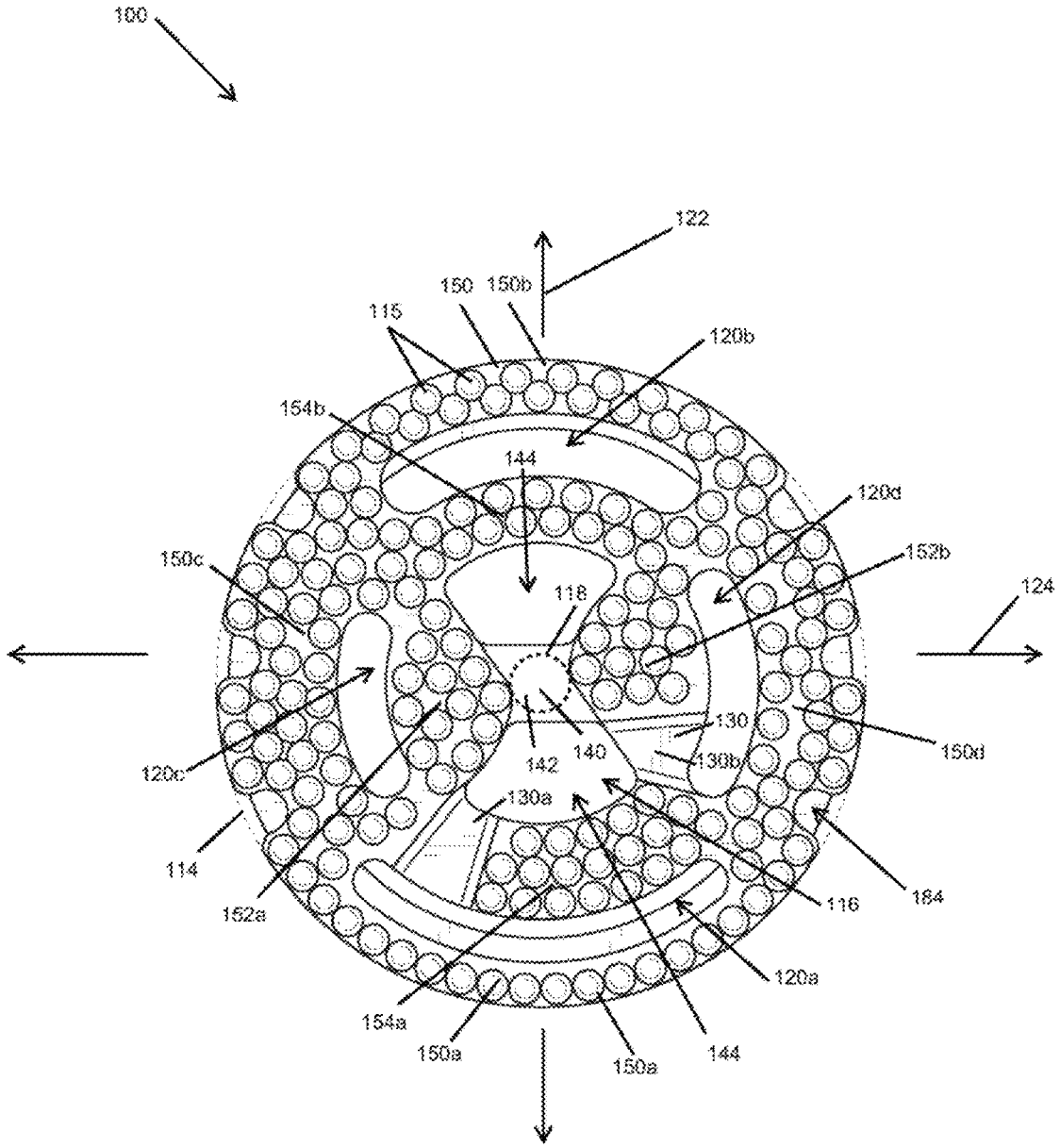
FIG. 3 is a distal end view of the drill bit of FIG. 2.

Referring to FIGS. 1 and 3, in some optional aspects, distal of the apex 182 (FIG. 12) of the base portion 140, the first and second inner surfaces of the first crown portion can be rotationally symmetric to the first and second inner surfaces of the second crown portion about the central axis. That is, it is contemplated that after some amount of rotation (optionally, about 180 degrees of rotation) of the second crown portion, the first and second inner surfaces of the second crown portion can look the same or substantially the same as the first and second inner surfaces of the first crown portion. Accordingly, in some aspects, distal of the apex 182 of the base portion 140, the core receiving slot 116 can have at least two degrees of rotational symmetry about the central axis 102 of the drill bit 100.

In some aspects, the medial axial edges 164 of the first and second core forming inner crown portions 152*a,b* are positioned on opposite sides of the first transverse axis.

The wall 150 can define at least one axial channel 184 that is radially inwardly recessed from the outer operative circumference 114 of the crown 110. For example, the wall can define a plurality of (e.g., three) axial channels on each side of the bit that are spaced along the second transverse axis 124. The axial channels 184 can permit fluid flowing from the peripheral channels 120 and across the cutting face to return distally along the outer surface of the drill string.

In some optional aspects, the crown 110 can be impregnated with diamonds, thereby allowing the crown to be used to cut hard formations and/or to increase the durability of the bit. The part of the bit that performs the cutting action, sometimes referred to as a face, can be generally formed of a matrix that contains a powdered metal or a hard particulate material, such as tungsten carbide. This material can be infiltrated with a binder, such as a copper-based alloy. The matrix and binder associated with the face can be mixed (impregnated) with diamond crystals (synthetic or natural) or another form of abrasive cutting media using conventional methods. As the drill bit grinds and cuts through the formation, the matrix and binder can erode and expose new layers of the diamond crystal (or other cutting media) so that sufficient cutting action is maintained during use of the drill bits disclosed herein.

In exemplary aspects, the crown 110 can optionally comprise a plurality of projections 115 extending distally from the cutting face 112. Optionally, the projections 115 can be integrally formed with the crown 110. Accordingly, the projections 115 can comprise the same matrix as the crown 110. In further embodiments, the projections 115 can comprise matrices that are different from their respective crowns. U.S. Pat. No. 9,637,980, issued to Longyear™ Inc. on Aug. 15, 2017, which is hereby incorporated herein by reference in its entirety, discloses further aspects of diamond impregnated bits and associated projections that can optionally be implemented with the drill bit 100. Optionally, in some aspects, the projections 115 can be distributed among a plurality of arcuate rows, with each arcuate row containing projections having a center point that is located at a given radius from the central axis. Optionally, in these aspects, it is contemplated that the projections within at least one arcuate row can radially overlap or be radially staggered with the projections of at least one other arcuate row. In further aspects, it is contemplated that the plurality of projections 115 can be evenly or substantially evenly distributed throughout the cutting face 112. In other aspects, it is contemplated that the plurality of projections 115 can have an uneven distribution, with selected areas of the cutting face 112 having a greater concentration of projections than other areas of the cutting face.

In various optional aspects, the peripheral slots cooperatively define a total open area (in cross sections in planes transverse to the longitudinal axis) that is at least the cross sectional area defined by the inner surface of the inner tube, further described herein, used with the drill bit. For example, in some aspects, the total open area of the peripheral slots can be at least 90%, at least 100%, at least 110%, at least 120%, or about 116% of the inner area of the inner tube. In this way, the bit can permit sufficient flow to return through the inner tube. According to some optional aspects, the total open area of the bit, determined by subtracting the surface area of the cutting face from the total area within the outer operative circumference, is between about 30% and about 50% (e.g., about 40%) of the total area within the operative circumference. For example, the total open area of the bit can be about 36%. Optionally, the core receiving slot can define between about 5% and about 15% (e.g., about 10%) of the area within the inner circumference of the drill bit. Optionally, the peripheral slots 120 can cooperatively define an area in a plane transverse to the longitudinal axis of the bit that is between about 15% and about 20% (e.g., about 17%) of the area within the inner circumference of the drill bit. Optionally, the axial channels 184 can cooperatively define an area in a plane transverse to the longitudinal axis of the bit that is between 0 and about 5% (e.g., about 3%) of the area within the inner circumference of the drill bit. Optionally, the face channels 130 can cooperatively define an area in a plane transverse to the longitudinal axis of the bit that is between about 5% and about 10% (e.g., about 6%) of the area within the inner circumference of the drill bit.

Drilling Assembly

Referring to FIGS. 13 and 14, a drilling assembly 300 can comprise an outer tube 302 and an inner tube 304 received within the inner tube. The inner tube 304 and outer tube 302 can cooperate to define an annular space 306. A drill bit (e.g., the drill bit 100) can be coupled to the outer tube 302. For example, the shank 104 can be threadedly coupled to the outer tube 302.

In some aspects, the drilling assembly 300 can further comprise a sub 310. The sub 310 can be configured to provide fluid communication between the core receiving slot and the inner tube 304. For example, the sub 310 can define a central bore 312 that extends between, and provides fluid communication between, the core receiving slot 116 of the crown 110 of the drill bit 100 and the inner tube 304. The sub 310 can have a proximal end 314 and a distal end 316. The central bore 312 can optionally be tapered proximally. For example, the spacing between outermost sides 145 of the conduits 144 can define a maximum flow width through the bit. It is contemplated that the inner diameter of the central bore 312 at the distal end 316 can be substantially equal to, or equal to, the maximum flow width. The central bore 312 at the proximal end 314 of the sub 310 can have the same, or substantially the same diameter as the inner diameter of the inner tube 304.

The sub 310 can define a shoulder 318. A cylindrical receiving space 320 can extend from the proximal end 314 of the sub to the shoulder 318. The cylindrical receiving space 320 can be configured to receive a distal end of the inner tube 304 so that the inner tube engages the shoulder 318. The drill bit can define receptacles 319 (FIG. 9) that receive respective legs of the sub, thereby inhibiting rotation of the sub relative to the drill bit. In some aspects, the proximal end of the sub can define a tapered surface 340 to guide the inner tube into the cylindrical receiving space. Optionally, the sub 310 can define one or more O-ring grooves that receive respective O-rings for providing a seal between the sub and the inner tube.

The proximal end 314 of the sub 310 can engage a portion of the drill bit to direct all, or substantially all flow from the core receiving slot 116 through the central bore 312 of the sub 310. For example, the drill bit 100 can define an inner cylindrical surface 320 that receives a portion of the proximal sub 310. The sub 310 can define a reduced diameter portion 322 that is receivable into the inner cylindrical surface 320. In this way, the central bore 312 at the proximal end 314 of the sub 310 can have the same, or substantially the same diameter as the inner diameter of the inner tube 304, thereby preventing a lip between the sub and the conduits 144.

The sub 310 can define a radial flange that is axially positioned between the outer tube 302 and the crown 110 of the drill bit 100. The radial flange 330 of the sub 310 can define at least one conduit 332 that is provides fluid communication between the annular space 306 and the at least one at least one peripheral slot.

Exemplary Method of Use

The drilling assembly 300 can be advanced into a formation 22 (FIG. 1) to form drilling cuttings 204 and core segments 204 as described herein. Fluid (e.g., water, drilling mud, or any suitable fluid) can be pumped through the annular space 306 between the inner and outer tubes. At least some of said fluid can travel through the peripheral slots 120, through the face channels, and return through the core receiving slot 116, through the conduits 144, and into the inner tube 304. The fluid flow rate and pressure can be sufficient to overcome fluid drag from the surface to the bottom of the bore and back to the surface as well as to provide sufficient fluid flow to cool the drill bit. Further, a sufficient fluid velocity can be maintained to avoid settling of core sample pieces.

The core segments returning through the inner tube can be collected. For example, once pumped from the borehole, a conduit can deliver the mix of drilling fluid, cuttings, and core segments to an apparatus (e.g., a screen or filter) that selectively filter out the larger segments pieces and allow the drilling fluid and cuttings to pass therethrough. Thus, the core sample pieces can be separated for analyzing the formation makeup. As the core segments are separated, the pieces can be associated with a select depth at which they were removed from the borehole. The core segments can be sufficiently large to enable geophysical interpretation of the drilled formation using conventional methods. In this way, the formation can be characterized. Optionally, the drilling cuttings can similarly be collected via the same or a different screen or filter.

Because, particularly for deeper boreholes, a substantial delay can exist between the time that the drill bit 100 breaks the core segments and the time that the core segments are pumped to the surface. During the substantial delay, the drill bit can travel to a lower depth. Thus, core sample pieces may not be associated with the (known) depth of the drill bit when the core sample pieces reach the surface. Accordingly, an operator may be able to account for the delay and approximate the actual depth from which the core sample pieces were taken.

Drill Bit for Single Tube Drill String

Figure 15:
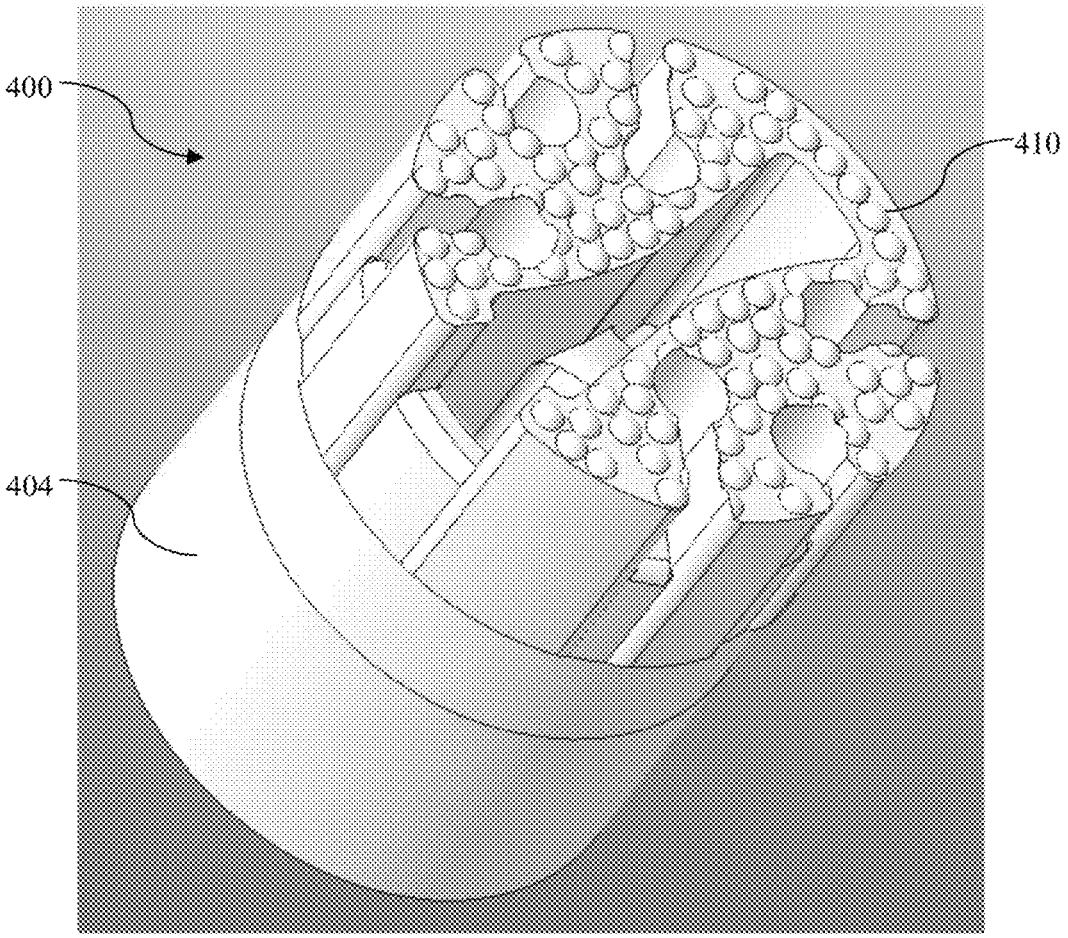
FIG. 15 is a perspective view of an exemplary drill bit in accordance with embodiments disclosed herein.
Figure 16:
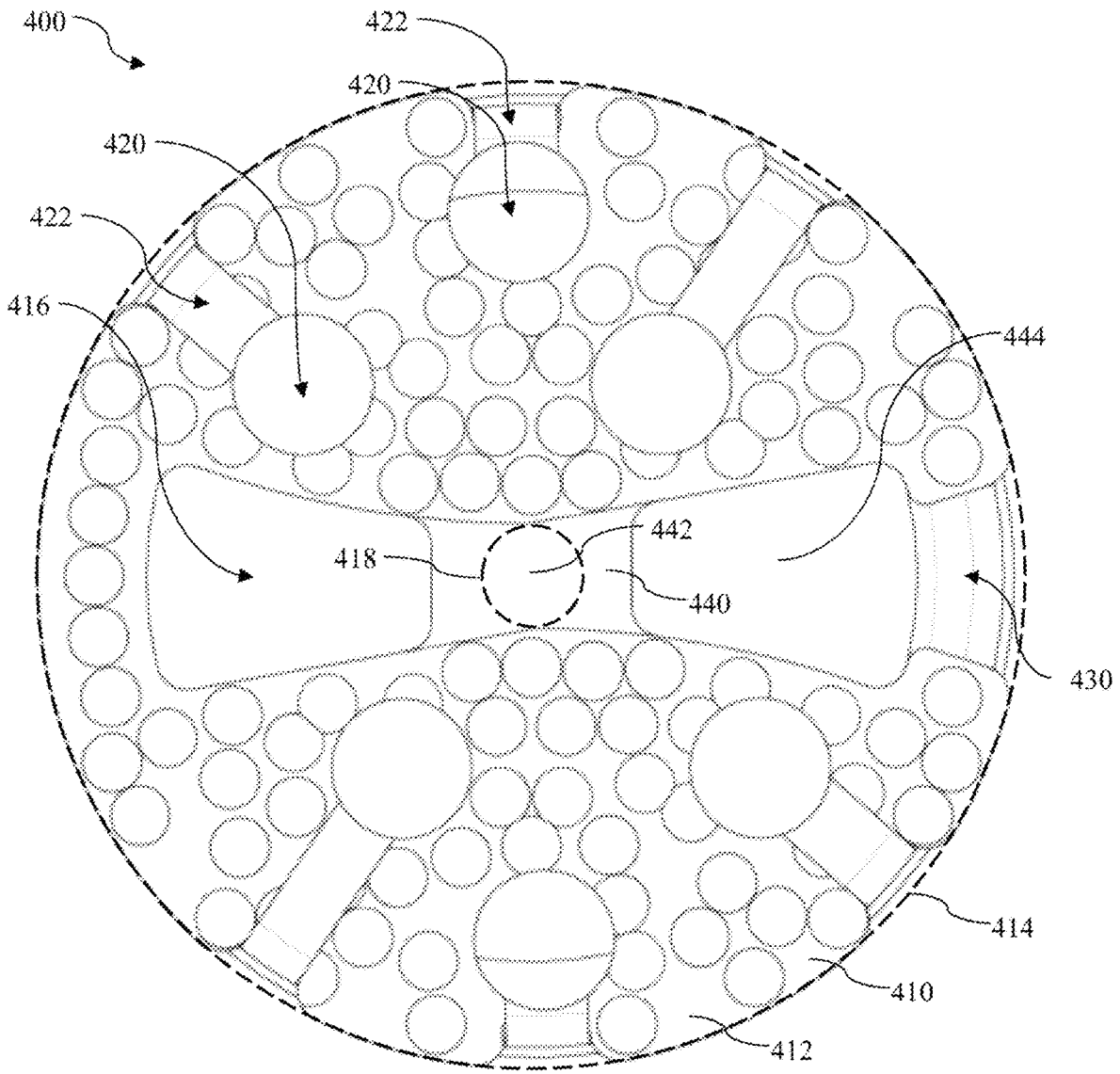
FIG. 16 is a distal end view of the exemplary drill bit of FIG. 15.
Figure 17:
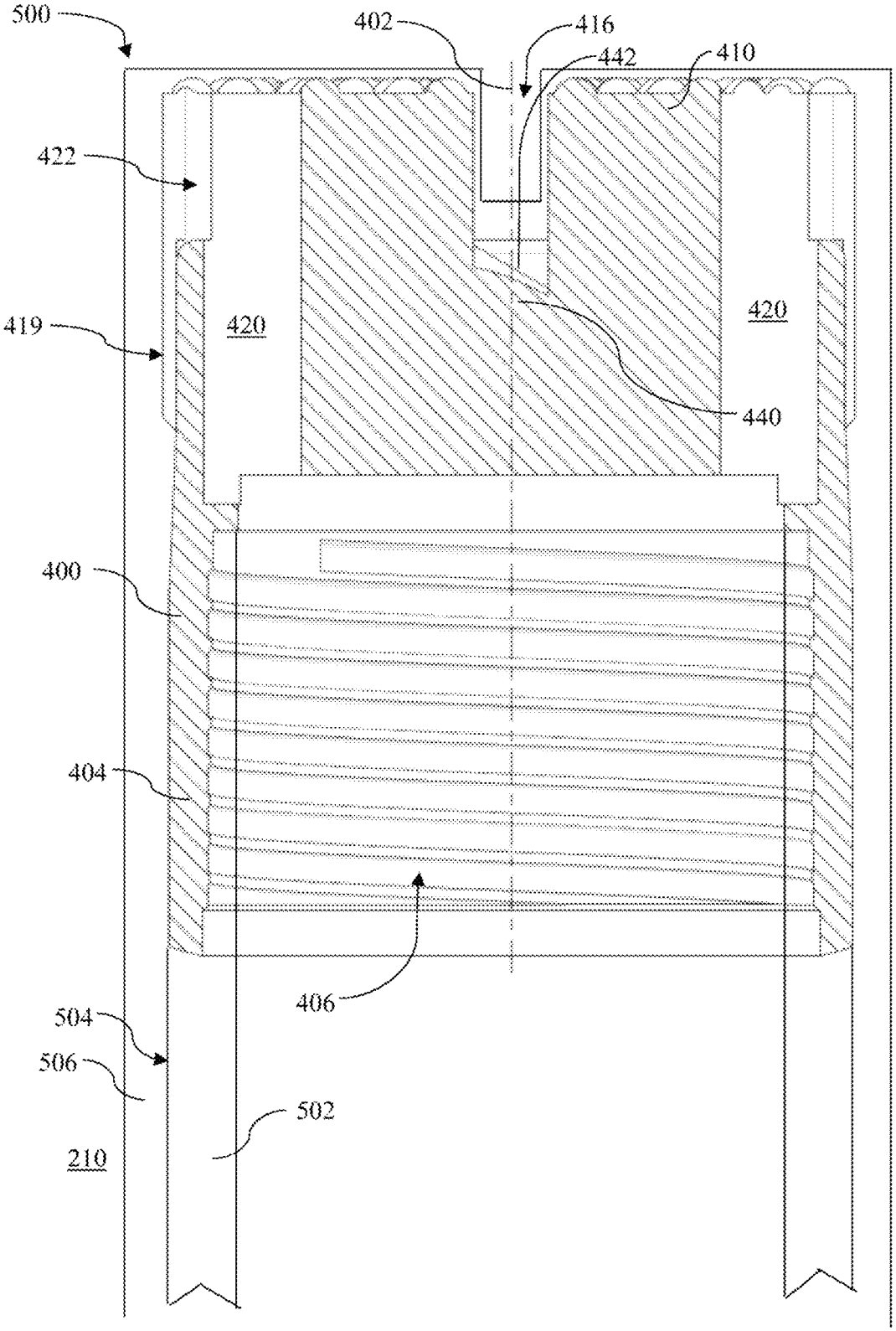
FIG. 17 is a cross sectional view of a system comprising a drill bit as in FIG. 15.

Some exemplary embodiments described herein are configured for dual-tube drill strings (e.g., an inner tube and an outer tube that define an annulus therebetween). However, further embodiments can employ single-tube drill strings. For example, referring to FIGS. 15-17, a drill bit 400 having a central axis 402 can comprise a shank 404 defining an inner bore 406. The drill bit 400 can further comprise crown 410 having a cutting face 412 and an outer operative circumference 414. The crown 410 can comprise a core-receiving slot 416 in communication with the inner bore 406 of the shank 404. The core receiving slot 418 can define an inner operative circumference 418 that is configured to form a core sample as described with reference to the bit 100 (FIG. 3). The crown 410 can further comprise at least one face channel 430. Each face channel 430 of the at least one face channel can extend between and be in fluid communication with the core-receiving slot 416 and the outer operative circumference 414 of the crown 410. A base portion 440 can be positioned within the core-receiving slot. The base portion 440 can defines a breaking surface 442. The breaking surface 442 can optionally be configured in accordance with the breaking surface 142 (FIG. 3) as disclosed with reference to the bit 100. For example, at least a portion of the breaking surface, or a plane tangential thereto, can be oriented at an oblique angle to the central axis. The face channel(s) 430 can be configured to receive fluid flowing distally along an outer surface 419 of the crown 410 and deliver fluid from the outer surface of the crown to the core-receiving slot 416. Optionally, the crown 410 can comprise only as single face channel 430. Said single face channel 430 can optionally be positioned on a side of the core receiving slot 416 having a lowest (proximal-most) portion of the break surface 442.

The crown can further define a plurality of peripheral ports 420 that are positioned between the core-receiving slot 416 and the outer operative circumference 414 that extend from, and provide fluid communication between, the cutting face 412 of the crown 410 and the inner bore 406 of the shank 404. Optionally, the bit can comprise six peripheral ports, having three peripheral ports 420 on each side of the cutting face. In exemplary aspects, the drill bit 400 can define radial flow channels 422 that extend proximally from the cutting face 412 and radially between the outer operative circumference of the drill bit and the peripheral ports 420. The peripheral ports 420 and radial flow channels 422 can provide fluid communication to enable sufficient fluid flow from an outer surface 420 of the crown 410 to the inner bore 406 of the shank 404. The peripheral ports 420 can optionally be cylindrical or generally cylindrical. The peripheral ports 420 can optionally be spaced from the central axis 402 by different radii. In this way, wear can be distributed across the bit.

Further aspects of the drill bit 100 (FIG. 2) consistent with the purpose and use of the drill bit 400 can be incorporated within the drill bit. For example, the drill bit 400 can define projections extending from the cutting face. The drill bit 400 can define conduits 444 that extend between the core receiving slot and the inner bore of the shank.

A drilling assembly 500 can comprise a tube 502 (e.g., comprising one or more drill rods) that is coupled to the drill bit 400. For example, the drill bit 400 can be threadedly coupled to the tube. The tube 502 and drill bit 400 can be advanced into a formation 210. Fluid can be pumped between an annulus 506 defined by an outer surface 504 of the tube 502 and the formation 210. Fluid can flow from the annulus, through the face channels, and return through the tube, mixed with drilling cuttings and core segments. Core segments returning through an interior of the tube can be collected. For example, the core segments be collected via a screen or filter. The drilling cuttings can similarly be collected via the same or a different screen or filter.

Exemplary Aspects

In view of the described products, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1. A drill bit having a central axis, the drill bit comprising: a shank defining an inner bore; and a crown having a cutting face, wherein the crown defines an outer operative circumference and comprises: a core-receiving slot in communication with the inner bore of the shank; at least one peripheral slot in communication with the inner bore of the shank, the at least one peripheral slot being positioned radially between the core-receiving slot and the outer operative circumference of the crown; at least one face channel, wherein each face channel of the at least one face channel extends between and is in (fluid) communication with the core-receiving slot and a respective peripheral slot of the at least one peripheral slot; and a base portion positioned within the core-receiving slot, wherein the base portion defines a breaking surface, wherein at least a portion of the breaking surface, or a plane tangential thereto, is oriented at an oblique angle to the central axis, wherein the at least one peripheral slot is configured to receive fluid moving in a distal direction toward the cutting face of the crown, and wherein the at least one face channel is configured to deliver fluid from the at least one peripheral slot to the core-receiving slot.

Aspect 2. The drill bit of aspect 1, wherein the crown comprises a plurality of projections extending distally from the cutting face.

Aspect 3. The drill bit of aspect 1 or aspect 2, wherein the at least one peripheral slot comprises a plurality of peripheral slots, and wherein at least one peripheral slot of the plurality of peripheral slots is not in communication with a face channel of the at least one face channel.

Aspect 4. The drill bit of any one of the preceding aspects, wherein the at least one peripheral slot comprises a plurality of peripheral slots, and wherein the at least one face channel comprises at least two face channels.

Aspect 5. The drill bit of any one of the preceding aspects, wherein the at least one peripheral slot comprises at least three peripheral slots, and wherein the at least one face channel comprises at least two face channels.

Aspect 6. The drill bit of any one of the preceding aspects, wherein the at least one peripheral slot comprises four peripheral slots.

Aspect 7. The drill bit of any one of the preceding aspects, wherein the at least one peripheral slot consists of four peripheral slots.

Aspect 8. The drill bit of any one of aspects 3-7, wherein at least one peripheral slot of the plurality of peripheral slots has a different arc length than at least one other peripheral slot of the plurality of peripheral slots.

Aspect 9. The drill bit of any one of aspects 3-8, wherein the plurality of peripheral slots comprises a pair of opposing peripheral slots spaced apart along a transverse axis that is perpendicular to the central axis.

Aspect 10. The drill bit of aspect 9, wherein a first peripheral slot of the pair of opposing peripheral slots has a different arc length than a second peripheral slot of the pair of opposing peripheral slots.

Aspect 11. The drill bit of any one of aspects 3-8, wherein the plurality of peripheral slots comprises first and second pairs of opposing peripheral slots, wherein the first pair of opposing peripheral slots are spaced apart along a first transverse axis that is perpendicular to the central axis, and wherein the second pair of opposing peripheral slots are spaced apart along a second transverse axis that is perpendicular to the central axis.

Aspect 12. The drill bit of aspect 11, wherein a first peripheral slot of the first pair of opposing peripheral slots has a different arc length than a second peripheral slot of the first pair of opposing peripheral slots, and wherein a first peripheral slot of the second pair of opposing peripheral slots has a different arc length than a second peripheral slot of the second pair of opposing peripheral slots.

Aspect 13. The drill bit of aspect 11 or aspect 12, wherein the first and second transverse axes intersect the central axis, and wherein the first and second transverse axes are perpendicular or substantially perpendicular to one another.

Aspect 14. The drill bit of any one of the preceding aspects, wherein the crown comprises: a wall that defines the outer operative circumference of the crown; and a plurality of inner crown portions that define the core-receiving slot.

Aspect 15. The drill bit of aspect 14, wherein each peripheral slot of the at least one peripheral slot is at least partially defined by: a respective outer wall portion of the wall of the crown; and a respective inner crown portion of the plurality of inner crown portions.

Aspect 16. The drill bit of aspect 15, wherein each face channel of the at least one face channel is defined by a respective inner crown portion of the plurality of inner crown portions.

Aspect 17. The drill bit of aspect 15 or aspect 16, wherein the at least one peripheral slot comprises a plurality of peripheral slots, wherein the outer wall portion that at least partially defines a first peripheral slot of the plurality of peripheral slots has a radial thickness that is different than a radial thickness of the outer wall portion that at least partially defines a second peripheral slot of the plurality of peripheral slots.

Aspect 18. The drill bit of aspect 17, wherein the outer wall portion that at least partially defines a third peripheral slot of the plurality of peripheral slots has a radial thickness that is different than a radial thickness of the outer wall portion that at least partially defines a fourth peripheral slot of the plurality of peripheral slots.

Aspect 19. The drill bit of aspect 17 or aspect 18, wherein the first peripheral slot is spaced from the second peripheral slot along a first transverse axis that is perpendicular or substantially perpendicular to the central axis.

Aspect 20. The drill bit of aspect 18 or aspect 19, wherein the third peripheral slot is spaced from the fourth peripheral slot along a second transverse axis that is perpendicular or substantially perpendicular to the central axis.

Aspect 21. The drill bit of aspect 20, wherein the second transverse axis is perpendicular or substantially perpendicular to the first transverse axis.

Aspect 22. The drill bit of any one of aspects 18-21, wherein the inner crown portion that at least partially defines a first peripheral slot defines a first face channel of the at least one face channel, wherein the first face channel extends between and is in communication with the core-receiving slot and the first peripheral slot, wherein the inner crown portion that at least partially defines the third peripheral slot defines a second face channel of the at least one face channel, and wherein the second face channel extends between and is in communication with the core-receiving slot and the third peripheral slot.

Aspect 23. The drill bit of aspect 22, wherein the inner crown portion that at least partially defines the second peripheral slot defines a third face channel of the at least one face channel, and wherein the third face channel extends between and is in communication with the core-receiving slot and the second peripheral slot.

Aspect 24. The drill bit of aspect 15 or aspect 16, wherein the at least one peripheral slot comprises a plurality of peripheral slots, wherein the inner crown portion that at least partially defines a first peripheral slot of the plurality of peripheral slots has a radial thickness that is different than a radial thickness of the inner crown portion that at least partially defines a second peripheral slot of the plurality of peripheral slots.

Aspect 25. The drill bit of aspect 24, wherein the first peripheral slot is spaced from the second peripheral slot along a first transverse axis that is perpendicular or substantially perpendicular to the central axis.

Aspect 26. The drill bit of aspect 24 or aspect 25, wherein the outer wall portion that at least partially defines the first peripheral slot has a radial thickness that is different than a radial thickness of the outer wall portion that at least partially defines the second peripheral slot.

Aspect 27. The drill bit of any one of aspects 24-26, wherein the inner crown portion that at least partially defines a first peripheral slot defines a first face channel of the at least one face channel, wherein the first face channel extends between and is in communication with the core-receiving slot the first peripheral slot.

Aspect 28. The drill bit of any one of aspects 17-27, wherein the outer wall portion that at least partially defines the first peripheral slot and the outer wall portion that at least partially defines the second peripheral slot define respective radial wall channels that are recessed from the cutting face and extend from the outer operative circumference of the crown to the respective first and second peripheral slots.

Aspect 29. The drill bit of any one of aspects 14-16, wherein the base portion extends between opposing first and second inner crown portions of the at least one inner crown portion, wherein the first and second inner crown portions are spaced apart along a first transverse axis that intersects the central axis of the drill bit and is perpendicular or substantially perpendicular to the central axis.

Aspect 30. The drill bit of aspect 29, wherein each of the first and second inner crown portions comprises: a first axial edge; a second axial edge; a medial axial edge; a first inner surface extending between the first axial edge and the medial axial edge; and a second inner surface extending between the medial axial edge and the second axial edge.

Aspect 31. The drill bit of aspect 30, wherein the first inner surface of each of the first and second inner crown portions is planar or substantially planar.

Aspect 32. The drill bit of aspect 30 or aspect 31, wherein the second inner surface of each of the first and second inner crown portions has a convex curvature.

Aspect 33. The drill bit of any one of aspects 30-32, wherein, for each of the first and second inner crown portions, a respective first plane containing the first axial edge and the medial axial edge and a second respective plane containing the medial axial edge and the second axial edge are angularly oriented relative to one another at an angle greater than 180 degrees.

Aspect 34. The drill bit of aspect 33, wherein the angle ranges from about 190 degrees to about 240 degrees.

Aspect 35. The drill bit of any one of aspects 30-34, wherein the medial axial edges of the first and second inner crown portions are positioned on opposite sides of the first transverse axis.

Aspect 36. The drill bit of any one of aspects 30-35, wherein the at least one inner crown portion further comprises opposing third and fourth crown portions that are spaced apart along a second transverse axis that is perpendicular or substantially perpendicular to the first transverse axis.

Aspect 37. The drill bit of aspect 36, wherein the third and fourth crown portions have respective inner surfaces that have concave curvatures.

Aspect 38. The drill bit of any one of aspects 30-37, wherein, distal of an apex of the base portion, the first and second inner surfaces of the first crown portion are rotationally symmetric to the first and second inner surfaces of the second crown portion about the central axis.

Aspect 39. The drill bit of any one of the preceding aspects, wherein the base portion defines an apex that is radially spaced from the central axis.

Aspect 40. The drill bit of any one of the preceding aspects, wherein the wall defines at least one axial channel that is radially inwardly recessed from the outer operative circumference of the crown.

Aspect 41. A drilling assembly comprising: an outer tube; an inner tube received within the outer tube, the inner tube and the outer tube cooperating to define an annular space; and a drill bit as recited in any one of the preceding aspects, wherein the shank of the drill bit is threadedly coupled to the outer tube.

Aspect 42. The drilling assembly of aspect 41, further comprising a drill sub having a proximal end and an opposed distal end, wherein the drill sub defines a central bore that extends between, and provides fluid communication between, the core receiving slot of the crown of the drill bit and the inner tube.

Aspect 43. The drilling assembly of aspect 42, wherein the drill sub defines a shoulder and a cylindrical receiving space that extends from the proximal end of the sub to the shoulder of the sub, wherein the inner tube is received within the cylindrical receiving space of the sub and biases against the shoulder of the sub.

Aspect 44. The drilling assembly of aspect 42 or aspect 43, wherein the sub defines a radial flange that is axially positioned between the outer tube and the crown of the drill bit, wherein the radial flange of the sub defines at least one conduit is configured to provide fluid communication between the annular space and the at least one at least one peripheral slot.

Aspect 45. The drilling assembly of any one of aspects 42-44, wherein the proximal end of the sub defines a tapered inner surface that is configured to guide the inner tube into the cylindrical receiving space.

Aspect 46. The drilling assembly of any one of aspects 42-45, wherein the bit defines an inner cylindrical surface that is configured to receive the proximal end of the sub, wherein the bit defines a plurality of conduits that provide fluid communication between the core reviving slot and the inner bore of the shank, wherein outermost sides of the conduits define a maximum flow width, wherein the maximum flow width is equal to or substantially equal to a radius of the center bore of the sub.

Aspect 47. The drilling assembly of any one of aspects 42-46, wherein the central bore of the sub has a proximal taper.

Aspect 48. A method comprising: advancing the drilling assembly as in any one of aspects 41-47 into a formation to form drilling cuttings and core segments.

Aspect 49. The method of aspect 48, further comprising: pumping fluid through the annular space; and collecting the core segments returning through the inner tube.

Aspect 50. The method of aspect 49, wherein collecting the core segments returning through the inner tube comprises filtering the core segments from the fluid.

Aspect 51. The method of aspect 49 or aspect 50, further comprising: collecting the drilling cuttings returning through the inner tube by filtering the drilling cuttings from the fluid.

Aspect 52. The method of aspect 51, wherein the steps of filtering the drilling cuttings from the fluid and filtering the core segments from the fluid are performed using the same filter.

Aspect 53. The method of aspect 51, wherein the steps of filtering the drilling cuttings from the fluid and filtering the core segments from the fluid are performed using separate filters.

Aspect 54. A drill bit having a central axis, the drill bit comprising: a shank defining an inner bore; a crown having a cutting face, wherein the crown has an outer circumferential surface, wherein the crown comprises: a core-receiving slot in communication with the inner bore of the shank; at least one face channel, wherein each face channel of the at least one face channel extends between and is in communication with the core-receiving slot and the outer operative circumference of the crown; and a base portion positioned within the core-receiving slot, wherein the base portion defines a breaking surface, wherein at least a portion of the breaking surface, or a plane tangential thereto, is oriented at an oblique angle to the central axis, wherein the at least one face channel is configured to receive fluid flowing distally along the outer surface of the crown and deliver fluid from the outer surface of the crown to the core-receiving slot.

Aspect 55. A drilling assembly comprising: a tube; and a drill bit as in aspect 49 that is threadedly coupled to the tube.

Aspect 56. A method comprising: advancing the drilling assembly as in aspect 55 into a formation to form drilling cuttings and core segments.

Aspect 57. The method of aspect 56, further comprising: pumping fluid between an annulus defined by an outer surface of the tube and the formation; collecting the core segments returning through the tube.

Aspect 58. The method of aspect 57, wherein collecting the core segments returning through the tube comprises filtering the core segments from the fluid.

Aspect 59. The method of aspect 57 or aspect 58, further comprising: collecting the drilling cuttings returning through the tube by filtering the drilling cuttings from the fluid.

Aspect 60. The method of aspect 59, wherein the steps of filtering the drilling cuttings from the fluid and filtering the core segments from the fluid are performed using the same filter.

Aspect 61. The method of aspect 59, wherein the steps of filtering the drilling cuttings from the fluid and filtering the core segments from the fluid are performed using separate filters.

Although the foregoing invention has been described in some detail by way of illustration and example for purposes of clarity of understanding, certain changes and modifications may be practiced within the scope of the appended claims.

What is claimed is:

1. A drill bit having a central axis, the drill bit comprising:

a shank defining an inner bore; and a crown having a cutting face and an outer circumferential surface, wherein the crown defines an outer operative circumference and comprises:

a core-receiving slot in communication with the inner bore of the shank;

at least one peripheral slot in communication with the inner bore of the shank, the at least one peripheral slot being within the drill bit and positioned radially between the core-receiving slot and the outer operative circumference of the crown, wherein the at least one peripheral slot is spaced radially inwardly from the outer circumferential surface of the crown, and wherein at least one peripheral slot extends axially from the inner bore of the shank to the cutting face;

at least one face channel, wherein each face channel of the at least one face channel extends between and is in fluid communication with the core-receiving slot and a respective peripheral slot of the at least one peripheral slot; and a base portion positioned within the core-receiving slot, wherein the base portion defines a breaking surface, wherein at least a portion of the breaking surface, or a plane tangential thereto, is oriented at an oblique angle to the central axis, wherein the at least one peripheral slot is configured to receive fluid moving in a distal direction toward the cutting face of the crown, and wherein the at least one face channel is configured to deliver fluid from the at least one peripheral slot to the core-receiving slot.

2. The drill bit of claim 1, wherein the crown comprises a plurality of projections extending distally from the cutting face.

3. The drill bit of claim 1, wherein the at least one peripheral slot comprises a plurality of peripheral slots, and wherein at least one peripheral slot of the plurality of peripheral slots does not have a face channel of the at least face cannel extending therefrom.

4. The drill bit of claim 3, wherein at least one peripheral slot of the plurality of peripheral slots has a different arc length than at least one other peripheral slot of the plurality of peripheral slots.

5. The drill bit of claim 3, wherein the plurality of peripheral slots comprises a pair of opposing peripheral slots spaced apart along a transverse axis that is perpendicular to the central axis.

6. The drill bit of claim 5, wherein a first peripheral slot of the pair of opposing peripheral slots has a different arc length than a second peripheral slot of the pair of opposing peripheral slots.

7. The drill bit of claim 3, wherein the plurality of peripheral slots comprises first and second pairs of opposing peripheral slots, wherein the first pair of opposing peripheral slots are spaced apart along a first transverse axis that is perpendicular to the central axis, and wherein the second pair of opposing peripheral slots are spaced apart along a second transverse axis that is perpendicular to the central axis.

8. The drill bit of claim 7, wherein a first peripheral slot of the first pair of opposing peripheral slots has a different arc length than a second peripheral slot of the first pair of opposing peripheral slots, and wherein a first peripheral slot of the second pair of opposing peripheral slots has a different arc length than a second peripheral slot of the second pair of opposing peripheral slots.

9. The drill bit of claim 7, wherein the first and second transverse axes intersect the central axis, and wherein the first and second transverse axes are perpendicular or substantially perpendicular to one another.

10. The drill bit of claim 1, wherein the at least one peripheral slot comprises a plurality of peripheral slots, and wherein the at least one face channel comprises at least two face channels.

11. The drill bit of claim 1, wherein the at least one peripheral slot comprises at least three peripheral slots, and wherein the at least one face channel comprises at least two face channels.

12. The drill bit of claim 1, wherein the crown comprises:

a wall that defines the outer operative circumference of the crown; and a plurality of inner crown portions that define the core-receiving slot, wherein each peripheral slot of the at least one peripheral slot is at least partially defined by:

a respective outer wall portion of the wall of the crown; and a respective inner crown portion of the plurality of inner crown portions.

13. The drill bit of claim 12, wherein each face channel of the at least one face channel is defined by a respective inner crown portion of the plurality of inner crown portions.

14. The drill bit of claim 12, wherein the at least one peripheral slot comprises a plurality of peripheral slots, wherein the outer wall portion that at least partially defines a first peripheral slot of the plurality of peripheral slots has a radial thickness that is different than a radial thickness of the outer wall portion that at least partially defines a second peripheral slot of the plurality of peripheral slots.

15. The drill bit of claim 14, wherein the outer wall portion that at least partially defines a third peripheral slot of the plurality of peripheral slots has a radial thickness that is different than a radial thickness of the outer wall portion that at least partially defines a fourth peripheral slot of the plurality of peripheral slots.

16. The drill bit of claim 15, wherein the third peripheral slot is spaced from the fourth peripheral slot along a second transverse axis that is perpendicular or substantially perpendicular to the central axis.

17. The drill bit of claim 15, wherein the inner crown portion that at least partially defines the first peripheral slot defines a first face channel of the at least one face channel, wherein the first face channel extends between and is in communication with the core-receiving slot and the first peripheral slot, wherein the inner crown portion that at least partially defines the third peripheral slot defines a second face channel of the at least one face channel, and wherein the second face channel extends between and is in communication with the core-receiving slot and the third peripheral slot.

18. The drill bit of claim 14, wherein the first peripheral slot is spaced from the second peripheral slot along a first transverse axis that is perpendicular or substantially perpendicular to the central axis.

19. The drill bit of claim 14, wherein the outer wall portion that at least partially defines the first peripheral slot and the outer wall portion that at least partially defines the second peripheral slot define respective radial wall channels that are recessed from the cutting face and extend from the outer operative circumference of the crown to the respective first and second peripheral slots.

20. The drill bit of claim 12, wherein the at least one peripheral slot comprises a plurality of peripheral slots, wherein the inner crown portion that at least partially defines a first peripheral slot of the plurality of peripheral slots has a radial thickness that is different than a radial thickness of the inner crown portion that at least partially defines a second peripheral slot of the plurality of peripheral slots.

21. The drill bit of claim 20, wherein the outer wall portion that at least partially defines the first peripheral slot has a radial thickness that is different than a radial thickness of the outer wall portion that at least partially defines the second peripheral slot.

22. The drill bit of claim 1, wherein the wall defines at least one axial channel that is radially inwardly recessed from the outer operative circumference of the crown.

23. The drill bit of claim 1, wherein the crown comprises a portion positioned between the at least one peripheral slot and the outer circumferential surface of the crown along a radial axis.

24. A drilling assembly comprising:

an outer tube;

an inner tube received within the outer tube, the inner tube and the outer tube cooperating to define an annular space; and a drill bit having a central axis, the drill bit comprising:

a shank defining an inner bore; and a crown having a cutting face and an outer circumferential surface, wherein the crown defines an outer operative circumference and comprises:

a core-receiving slot in communication with the inner bore of the shank;

at least one peripheral slot in communication with the inner bore of the shank, the at least one peripheral slot being within the drill bit and positioned radially between the core-receiving slot and the outer operative circumference of the crown, wherein the at least one peripheral slot is spaced radially inwardly from the outer circumferential surface of the crown, and wherein at least one peripheral slot extends axially from the inner bore of the shank to the cutting face;

at least one face channel, wherein each face channel of the at least one face channel extends between and is in fluid communication with the core-receiving slot and a respective peripheral slot of the at least one peripheral slot; and a base portion positioned within the core-receiving slot, wherein the base portion defines a breaking surface, wherein at least a portion of the breaking surface, or a plane tangential thereto, is oriented at an oblique angle to the central axis, wherein the at least one peripheral slot is configured to receive fluid moving in a distal direction toward the cutting face of the crown, and wherein the at least one face channel is configured to deliver fluid from the at least one peripheral slot to the core-receiving slot, and wherein the shank of the drill bit is threadedly coupled to the outer tube.

25. The drilling assembly of claim 24, further comprising a drill sub having a proximal end and an opposed distal end, wherein the drill sub defines a central bore that extends between, and provides fluid communication between, the core receiving slot of the crown of the drill bit and the inner tube.

26. A drill bit having a central axis, the drill bit comprising:

a shank defining an inner bore;

a crown having a cutting face, wherein the crown has an outer circumferential surface, wherein the crown comprises:

a core-receiving slot in communication with the inner bore of the shank, wherein the core-receiving slot is at least partly defined by at least one longitudinally extending internal wall;

at least one face channel, wherein each face channel of the at least one face channel extends between and is in communication with the core-receiving slot and the outer operative circumference of the crown, wherein the face channel comprises a pair of side walls, wherein the pair of sidewalls of the face channel extend to and intersect the at least one longitudinally extending internal wall at the cutting face of the crown; and a base portion positioned within the core-receiving slot, wherein the base portion defines a breaking surface, wherein at least a portion of the breaking surface, or a plane tangential thereto, is oriented at an oblique angle to the central axis, wherein the at least one face channel is configured to receive fluid flowing distally along the outer circumferential surface of the crown and deliver fluid from the outer circumferential surface of the crown to the core-receiving slot.

27. The drill bit of claim 26, wherein the at least one face channel and the core receiving slot define a fluid pathway that extends along a radial axis from the outer operative circumference of the crown to the central axis of the crown.

28. The drill bit of claim 26, further comprising at least one peripheral port extending between the inner bore of the shank and the cutting face of the crown.

29. The drill bit of claim 28, further comprising at least one radial flow channel defined by a portion of the crown recessed from the cutting face, wherein each radial flow channel of the at least one radial flow channel extends between the outer circumferential surface and a respective peripheral port of the at least one peripheral ports.

* * * * *